US011164416B2

(12) United States Patent
Danielson et al.

(10) Patent No.: US 11,164,416 B2
(45) Date of Patent: Nov. 2, 2021

(54) METHOD AND SYSTEM TO CONTROL AND MANIPULATE VIDEO ON GAMING PLATFORMS

(71) Applicant: IGT, Las Vegas, NV (US)

(72) Inventors: Patrick Danielson, Las Vegas, NV (US); Dwayne Nelson, Las Vegas, NV (US); Samantha Ascheri-Phillips, Reno, NV (US)

(73) Assignee: IGT, Las Vegas, NV (US)

( * ) Notice: Subject to any disclaimer, the term of this patent is extended or adjusted under 35 U.S.C. 154(b) by 29 days.

(21) Appl. No.: 16/718,843

(22) Filed: Dec. 18, 2019

(65) Prior Publication Data

US 2021/0192888 A1 Jun. 24, 2021

(51) Int. Cl.
*G07F 17/32* (2006.01)

(52) U.S. Cl.
CPC ..... *G07F 17/3211* (2013.01); *G07F 17/3223* (2013.01); *G07F 17/3227* (2013.01)

(58) Field of Classification Search
CPC ..... G07F 17/3211; G07F 17/3223; G07F 17/3227; G07F 17/32
See application file for complete search history.

(56) References Cited

U.S. PATENT DOCUMENTS 8,147,334 B2 4/2012 Gatto et al.
8,764,566 B2 7/2014 Miltenberger et al.
1,058,025 A1 3/2020 Czubak et al.
2002/0086732 A1* 7/2002 Kirmse ..... A63F 13/795 463/42
2003/0064807 A1* 4/2003 Walker ..... G07F 17/3237 463/42
2004/0192439 A1* 9/2004 Kula ..... G07F 17/3241 463/29
2006/0009285 A1 1/2006 Pryzby et al.
2007/0243925 A1 10/2007 LeMay et al.
2008/0009344 A1* 1/2008 Graham ..... G07F 17/3244 463/25
2008/0228511 A1 9/2008 Barden
2009/0093300 A1* 4/2009 Lutnick ..... G07F 17/3244 463/26
2010/0240455 A1* 9/2010 Gagner ..... G07F 17/32 463/30
2014/0094274 A1 4/2014 Guinn et al.

OTHER PUBLICATIONS

Official Action for U.S. Appl. No. 16/684,071, dated Apr. 14, 2021 21 pages.

* cited by examiner

*Primary Examiner* — Kevin Y Kim
(74) *Attorney, Agent, or Firm* — Sheridan Ross P.C.

(57) ABSTRACT

The present disclosure relates generally to media and multimedia synchronization systems and methods. As a non-limiting example, a gaming system and method processes event-related signals from gaming devices to identify a particular occurrence of an event and generates a media content message based on the particular occurrence of the event and transmits the media content message to multiple target gaming devices. The multiple target gaming devices determine which of their output devices is available and causes the available output devices to present, synchronously with the output devices of the other target gaming devices, the media content to collectively provide a selected presentation.

20 Claims, 21 Drawing Sheets

METHOD AND SYSTEM TO CONTROL AND MANIPULATE VIDEO ON GAMING PLATFORMS

BACKGROUND

The present disclosure is generally directed to gaming devices and, in particular, towards systems and methods that enable multimedia synchronization between gaming devices and other display devices in a common area.

Gaming devices, such as slot machines or Electronic Gaming Machines (EGMs), are frequently positioned in close proximity to one another to maximize usage of casino floor space. The gaming devices frequently display different media content depending on the mode of the gaming device.

BRIEF SUMMARY

In certain embodiments, the present disclosure relates to a server, gaming device, and method that provide media and multimedia synchronization capabilities. In some embodiments, a gaming server is provided, comprising: a signal input that interfaces with a network in communication with different first and second gaming devices; a processor coupled with the signal input; and a computer-readable storage medium, coupled with the processor and comprising instructions stored thereon that are executable by the processor. In some embodiments, the instructions include: a set of instructions that processes event-related signals received at the signal input from the first and second gaming devices and identifies a particular occurrence of an event based on processing the event-related signals; a set of instructions that generates a first media content message based on the particular occurrence of a event associated with the second gaming device, the first media content message indicating selected first media content to be provided by an output device of the first gaming device in response to the identified particular occurrence of the event, and the selected first media content being related to the event; and a set of instructions that transmits the first media content message to the first gaming device.

In some embodiments, a gaming device is provided, comprising: a signal input that interfaces with a gaming network; an output device to provide media content; a processor coupled with the signal input and the output device; and a computer-readable storage medium, coupled with the processor and comprising instructions stored thereon that are executable by the processor. In some embodiments, the instructions include: a set of instructions that receives, via the signal input, a media content message to provide selected media content related to an event associated with a different gaming device; a set of instructions that, in response to the media content message, determines whether the gaming device is currently associated with (e.g., is performing or executing) a first operation or a different second operation; and a set of instructions that, when the gaming device is currently associated with the first operation, causes the output device to provide the selected media content and, when the gaming device is currently associated with the second operation, causes the output device to provide media content different from the selected media content.

In some embodiments, a method comprises: receiving, at a processor, a media content message to provide by an output device selected media content; in response to the media content message, determining, with the processor, whether a gaming device associated with the processor is currently associated with a first operation or a second operation; and applying, with the processor, the following rules: when the gaming device is currently associated with the first operation, causing the output device to provide, during a time period, the selected media content, a timing of the provision of the selected media content by the output device of the gaming device being determined by a synchronization parameter, and when the gaming device is currently associated with the second operation, providing by the output device, during the time interval, media content different from the selected media content.

Additional features and advantages are described herein and will be apparent from the following Description and the figures.

DETAILED DESCRIPTION

Figure 1:
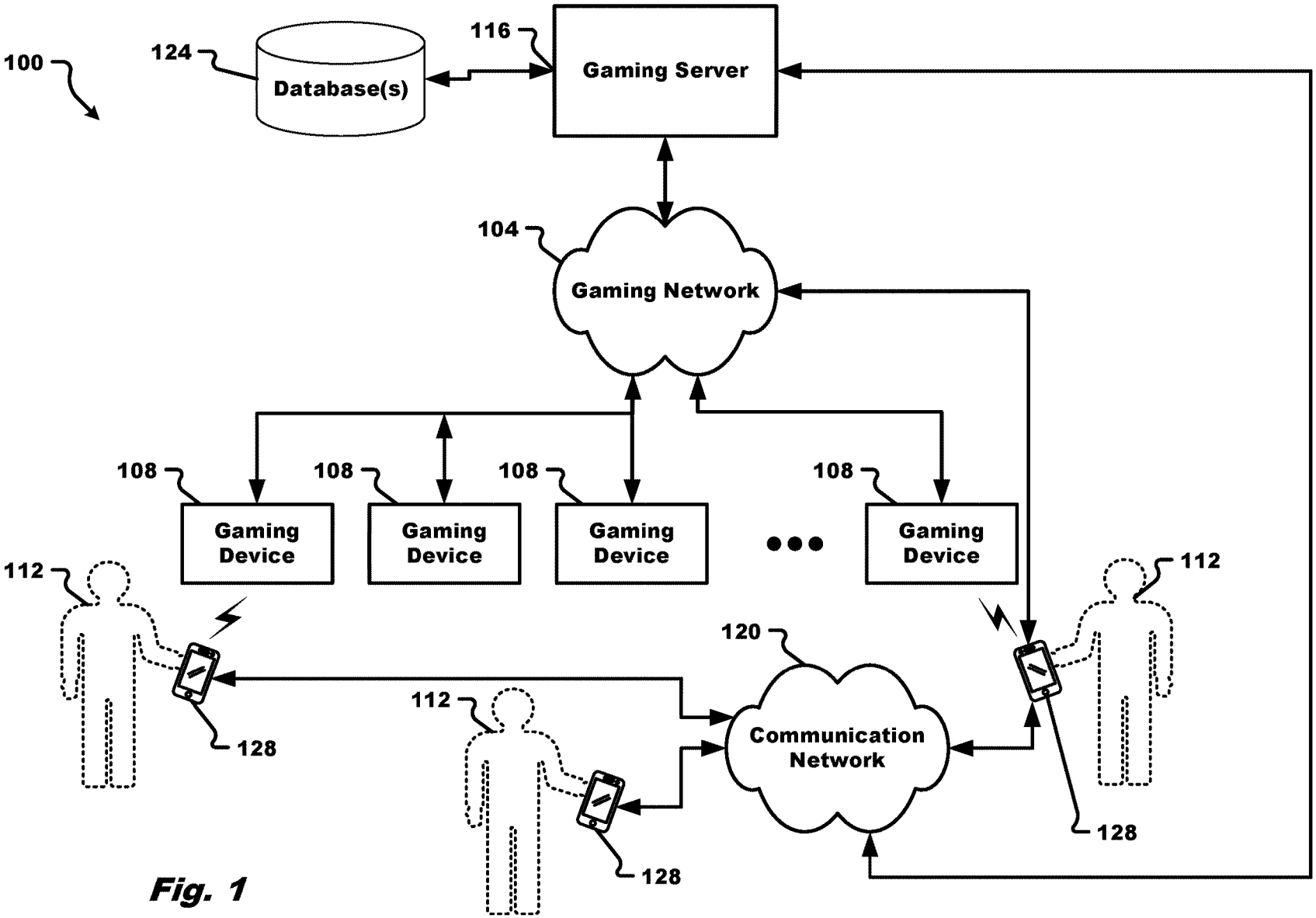
FIG. 1 is a block diagram depicting a gaming system in accordance with at least some embodiments of the present disclosure.

Embodiments of the present disclosure will be described in connection with a gaming system having one or multiple gaming devices that can render substantially synchronized media content display presentations in response to sensed events involving one or more of the gaming devices. The gaming devices may comprise any computing device, personal gaming device, mobile phone, mobile device, Electronic Gaming Machine (EGM), Electronic Table Game (ETG), or collection of computing devices that receive and render information about sensed events in a specific display presentation based on a number of criteria.

Embodiments of the present disclosure can provide systems and methods related to synchronizing device outputs based on sensed events. In some embodiments, the systems and methods disclosed herein may synchronize device outputs in a casino environment relative to an event sensed by or otherwise involving a gaming device. A casino may have one or more EGMs, one or more other gaming devices (e.g., personal gaming devices carried by players), electronic table games, and other devices that are capable of producing visible, tactile, and audible outputs. A casino may also have a gaming server that is capable of providing the casino with games of skill and/or chance, odds, and other wager opportunities that can be wagered on by players in the casino or by players having a mobile gaming device. The player may be allowed to place wagers on such sensed events at EGMs, ETGs, at mobile gaming devices, or the like.

Embodiments of the present disclosure can provide systems and methods that will enhance a player's experience in a casino environment and provide higher levels of casino revenue. In some embodiments, output devices (e.g., displays, monitors, speakers, lights, tactile or haptic output devices (such as device control stimulations generated by one or more of pneumatically, vibrotactilely, electrotactily, functional neuromuscularly, etc.) of gaming devices (e.g., EGMs, ETGs, and portable devices, etc.)) may be leveraged to enhance excitement within the casino environment by synchronizing and manipulating media content provided by the output devices of different gaming devices. Being able to synchronize and manipulate media content can allow the casino operator to create and control unique attract and advertising methods on the EGM, ETG, and other gaming device displays by dynamically changing the media content in response to sensed activities, operations, availabilities, or other sensed events on the gaming devices or in a common, selected, or otherwise defined spatial area and while being aware of the activity on and availability of the gaming devices or the spatial area of the gaming devices.

More specifically, and without limiting embodiments described herein, the media content displayed by monitors and/or provided by other output devices on a collection or bank of gaming devices can be substantially synchronized to render collectively a multimedia presentation in which different output devices on a selected gaming device and on different gaming devices render different parts of the presentation. Outputs generated by gaming devices can be coordinated such that the collection of gaming devices presents a unified and orchestrated presentation. The gaming devices may all play the same sound and flash lights in the exact same manner for player excitement. The gaming devices may alternatively or additionally perform animations and sequences that highlight one or more particular gaming devices, which draws attention to that gaming device.

This synchronization can be achieved using a number of different methods. One possible method is to have a gaming device broadcast or multicast a media content message to a communication network for delivery to other gaming devices. The other gaming devices may receive the message and begin the appropriate output sequence. In another embodiment, the media content message may contain a start time, which may be only a few seconds in the future. If all of the selected gaming devices have a synchronized or substantially synchronized clock, using a protocol such as Network Time Protocol (NTP), then the animation will start at the same time across multiple gaming devices.

Another possible method is to utilize a centralized gaming server as a type of gaming server that instructs the gaming devices to perform a particular animation or sequence. The centralized gaming server may be configured to download content and sequences to the terminals via one or more media content messages and instruct one or more gaming devices to play the content to provide an exciting casino experience. In embodiments not necessarily related to the display of a sensed event, the gaming server may still be configured to trigger an animation across one or more gaming devices based upon a media content message received from a gaming device where a player has made a winning wager or presented a winning ticket.

The presentation can be related to the sensed event and can be changed based on sensed event changes. The presentation can be any media or multimedia content that is directed toward a player or other selected audience. The media content can be an advertisement, an interactive game, information about a specific player, game, or gaming, mobile, or other type of gaming device, or other type of presentation selected by the operator or gaining server to have a selected effect on one or more players or potential players. In one non-limiting example, the operator or gaming server determines that a gaming device is due to hit through metering or some other system and the presentation provides a physical cue, such as plants growing or some other visual activity occurring on the output devices of the gaming device or adjacent gaming device to emphasize to potential players that the gaming device is "hot". In another non-limiting example, characters, such as fish, move around all of the displays of multiple gaming devices. When a player touches the character, the character swims away with a path that goes through multiple displays of different gaming devices. In another non-limiting example when a gaming device mystery bonus is at a near hit level, the displays of adjacent gaming devices can display fish swarming the mystery bonus gaming device, particularly when the adjacent gaming devices are in the attract mode. When a player plays the mystery bonus gaming device, the displays of the adjacent gaming device and/or mystery bonus gaming device can display food being ejected from the mystery bonus gaming device to the adjacent gaming devices, which causes the displayed fish the swarm around the mystery bonus gaming device. In yet another non-limiting example, a highly ranked carded player starts playing a gaming device. While he or she plays, the surrounding gaming devices and an overhead topper output device (e.g., display) display a crown and gold laced vines growing around the gaming device in play mode. In yet another non-limiting example, a selected game theme is created for the presentation to link selected gaming and mobile devices for a community bonus, such as a musical chairs or hot potato theme. When a bank is full, or mostly full, a community bonus game could activate and be presented where the players via the presenting gaming devices can interact with Dr. Seuss Things or other objects running or moving around the touchscreen displays of the gaming devices. The players can virtually catch the Dr. Seuss Things or other objects with a net icon, and the caught objects can have award values provided to the "catching" player. In yet another non-limiting example, players can send displayed characters or objects from a display of a first gaming, mobile, or other type of gaming device to displays of one or more other gaming, mobile, or other type of gaming devices such that the characters or objects are displayed as moving through other games on their way to "steal" screen elements or "gift" screen elements on the displays of the other gaming, mobile, or other type of gaming devices. In a further non-limiting example, the gaming device sensors (e.g., cameras and video processing components) can recognize a woman with a red dress walking by. The gaming device audibly and visually calls out to the woman with the description of what she is wearing to entice her to play the game. As she moves along the bank of gaming devices, each nearest gaming device of the bank of gaming devices successively uses its output devices to audibly and visually call out to the woman. As will be appreciated, numerous other examples embodying the concepts of this disclosure can be envisioned by one or ordinary skill in the art.

The media content can have any format and use one or more different content forms, such as text, audio, images, animations, video and interactive content. The media content can be linear or non-linear depending on the application. In some embodiments, the media content is 2 dimensional, 3 dimensional, 4 dimensional, or variations thereof (e.g., 2.5 dimensional).

Embodiments of the present disclosure contemplate coordinating gaming device outputs with sensed events, such as events that can be wagered upon, and changes in sensed events. By way of non-limiting example, various different types of gaming devices in a casino can be synchronized or coordinated to produce certain outputs based on a sensed event associated with one or more gaming, mobile, or other type of gaming devices. The sensed event changes can be associated with a common gaming device or different gaming devices. Non-limiting examples of sensed events include a state or mode of the gaming device (such as a play mode, idle mode, attract mode, error mode, or offline mode), information relating to an identified player of a gaming device (such as a player ranking, winning history, preferences, etc.), gaming information relating to a game being played on a gaming device (such as a game outcome or state (e.g., score, award, winnings, or bonus or proficiency level) and the like), a change in odds associated with an outcome of a gaming device (such as a gaming device having an increased likelihood of a winning outcome sensed by metering or some other metric or subsystem), player or potential player activity in spatial proximity to a gaming device, and association of gaming devices with one another (such as in a game involving multiple gaming devices (e.g., community bonus game or "Big Bertha" multi-reel slot machine in which the set of display outputs of each gaming device correspond to a different reel and present, collectively, all of the reel outputs). The association of multiple gaming devices can include gaming devices alone, mobile devices alone, or combinations of gaming and mobile devices.

Each of the gaming devices can have discretion on whether or not to display the selected media content based on application of a set of rules. More specifically, and without limiting embodiments described herein, the set of rules can include: when the selected gaming device is performing a first action, the selected gaming device displays the selected media content; but when the selected gaming device is performing a different second action, the selected gaming device displays media content different from the selected media content. The second action can be required by governing statue, law, regulation, or other legal or operator requirement. In certain situations, one or more display devices is required to provide preselected content, such as player warnings, advisory messages, or other required media content (e.g., wager limits and other gambling restrictions, last win date and amount, progressive amounts, odds of a winning or losing outcome, etc.). In some embodiments, the second action can be associated with an interaction with a player directly or via a mobile device.

The media content provided to each gaming device can be altered to reflect their differing output device configurations. A set of instructions can be provided that adjusts a display parameter of the selected first media content based on the first and second display configurations. More specifically, and without limiting embodiments described herein, a display parameter associated with the media content can be adjusted for a first display configuration of a first display device and adjusted differently for a second display configuration of a second display device. The first and second display devices can be on the same gaming device or different gaming devices. The display parameter can be, for instance, aspect ratio, contrast ratio, screen resolution, refresh rate, response time, screen size, and/or viewing angle. Being aware of display parameters, such as dots per inch ("DPI"), can enable modification of the media content to provide a presentation similar in size when moving between displays.

Embodiments of the present disclosure can provide a system and method to generate media content for a presentation to be provided by multiple gaming devices. A gaming server receives images of a output devices associated with different gaming devices, provides an operator or other user with a display comprising the output device images and an object to be rendered by the output devices, and receives from the user a trajectory of movement of a selected object across the output device images. The gaming server can generate the selected media content based on the trajectory of movement.

By way of non-limiting example, the casino operator can cause the gaming devices to be in a monitor recognition mode that uses a mobile device application executing on a mobile device to take images of the output devices in each of the gaming devices in a bank of gaming devices. The image identifies each gaming device output device configuration and capabilities, screen size, resolution, and dots per inch ("DPI") setting. The operator can identify, name, and map the gaming device locations in the bank within the application. The application can recognize and import the configuration and capabilities to automatically import and configure each gaming device bank side when the operator uses a higher level video processing application or tablet interface.

All of the examples depicted and described herein could be implemented with video instead of or in addition to simple light emitters (e.g., LEDs, panel of LEDs, etc.). The gaming devices could display colors, patterns, video, etc. on one or more areas of one or more display devices or monitors. In one non-limiting example, the gaming device display could alter the background colors, button colors or any other element on the screen in response to the sensed event.

These and other embodiments will now be described in further detail with reference to the appended figures.

Gaming System

With reference initially to FIG. 1, details of an illustrative gaming system 100 will be described in accordance with at least some embodiments of the present disclosure. The components of the gaming system 100, while depicted as having particular instruction sets and devices, are not necessarily limited to the examples depicted herein. Rather, a system according to embodiments of the present disclosure may include one, some, or all of the components depicted in the system 100 and does not necessarily have to include all of the components in a single device. For instance, the components of a server may be distributed amongst a plurality of servers and/or other devices (e.g., gaming devices, EGMs, ETGs, video game gambling machine ("VGM"), mobile devices, etc.) in the system 100 without departing from the scope of the present disclosure.

The gaming system 100 is shown to include a communication or gaming network 104 that interconnects and facilitates machine-to-machine communications between one or multiple gaming devices 108, a gaming server 116, a database 124, a communication network 120, and mobile devices 128. In some embodiments, the functionality of the gaming server 116 may be provided in one or more gaming devices 108, in one or more mobile devices 128, or may be otherwise distributed across the system 100 in a manner other than the one depicted in FIG. 1. In some embodiments, the gaming devices 108, gaming server 116, and mobile devices 128 may be configured to communicate using various nodes or components of the gaming and/or communication networks 104 and 120.

The gaming and communication networks 104 and 120 may comprise any type of known communication medium or collection of communication media and may use any type of protocols to transport messages between endpoints. The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the gaming and communication networks 104 and 120 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the gaming and communication networks 104 and 120 need not be limited to any one network type, and instead may be comprised of a number of different networks and/or network types. Moreover, the gaming and communication networks 104 and 120 may comprise a number of different communication media such as coaxial cable, copper cable/wire, fiber-optic cable, antennas for transmitting/receiving wireless messages, and combinations thereof.

In some embodiments, the gaming devices 108 may be distributed throughout a single property or premises (e.g., a single casino floor) or the gaming devices 108 may be distributed among a plurality of different properties. In a situation where the gaming devices 108 are distributed in a single property or premises, the communication network 104 may include at least some wired connections between network nodes. As a non-limiting example, the nodes of the gaming and communication networks 104 and 120 may communicate with one another using any type of known or yet-to-be developed communication technology. Non-limiting examples of such technologies include, without limitation, Ethernet, SCSI, PCIe, RS-232, RS-485, USB, ZigBee, WiFi, CDMA, GSM, HTTP, TCP/IP, UDP, etc.

The gaming devices 108 may utilize the same or different types of communication protocols to connect with the gaming and communication networks 104 and 120. It should also be appreciated that the gaming devices 108 may or may not present the same type of wagering interface, game, video presentation of an event, or alternative presentation of an event to a player 112. For instance, a first gaming device 108 may correspond to a gaming device that presents a slot game to the player 112, the second gaming device 108 may correspond to a sports wagering terminal or sports wagering kiosk, a third gaming device 108 may correspond to an electronic table game, and other gaming devices 108 may present other types of games or a plurality of different games for selection and eventual play by a player 112. It may be possible for the some of the gaming devices 108 to communicate with one another via the communication network 104.

In some embodiments, the gaming server 116 may correspond to a system used within a casino to manage slot games, video poker games, bingo games, keno games, or the like that are played on one or more of the gaming devices 108. Although not depicted, it should be appreciated that the gaming server 116 may include one or multiple servers that execute instructions in connection with managing the games or wager capabilities made available at the gaming devices 108.

In some embodiments, a player 112 may be enabled to enhance their experience with the gaming devices 108 via interactions with their personal mobile device 128. In some embodiments, a mobile device 128 may be configured to execute one or more games of chance that are also executable by a gaming device 108. For instance, a player 112 may be allowed to play a video-based table game of chance (e.g., a card game, a roulette game, a dice game, etc.) at their mobile device 128 without ever having to physically engage a gaming device 108. The mobile device 128 may correspond to a mobile devices such as portable communications devices, personal computers, and/or other microprocessor-enabled devices having memory and communications interfaces. Non-limiting examples of a mobile device include a cellular phone, a smartphone, a tablet, a wearable device, an augmented reality headset, a virtual reality headset, a laptop, a Personal Computer (PC), or the like.

In some embodiments, a mobile device 128 may be configured to communicate directly with a gaming device 108. Direct communications may utilize a proximity-based communication protocol such as NFC, Bluetooth®, BLE, WiFi, or the like. Alternatively or additionally, the mobile devices 128 may be configured to communicate with other mobile devices 128 and/or the gaming server 116 via the communication network 108. Such communications may be secured (e.g., encrypted) or unsecured depending upon the nature of information exchanged during the communications. A mobile device 128 may correspond to a player's 112 personal device that uses an unsecured or untrusted communication network 108 or to a device issued to the player 112 during the player's visit at a particular casino, in which case the mobile device 128 may be administered with certain casino-approved security policies.

It should be appreciated that the gaming server 116 may or may not be co-located with the gaming devices 108. Further still, players 112 may be allowed to carry multiple mobile devices 128, which may or may not be required to communicate or pair with a gaming device 108.

FIG. 1 also depicts the possibility of some mobile devices 128 being paired with a gaming device 108, thereby enabling communications to flow between the mobile device 128 and gaming device 108. This communication may utilize a proximity-based communication protocol, such as Bluetooth, BLE, NFC, WiFi, etc. FIG. 1 further shows that one or more mobile devices 128 may not necessarily be paired with a gaming device 108, but such mobile devices 128 may still be configured to communicate with the gaming server 116 via the communication network 108.

The gaming server 116, as will be described in further detail herein, may be configured to receive information from gaming devices 108 regarding sensed events and synchronize outputs made at gaming devices 108 in response to the sensed events to enhance the player's 112 experience associated with such sensed events. The sensed events can be associated with any event of interest, such as involving or associated with a player, game, or device.

In some embodiments, the gaming server 116 may be configured to determine player information of a player 112 or multiple players 112 in a casino environment (e.g., within a common or selected area or on a casino floor) and may customize outputs produced by the gaming devices 108 within the common or selected area based on the preferences and based on event-related signals received by the gaming server 116 from gaming or mobile devices 108 and 128. As a non-limiting example, the player 112 can have preferences regarding output(s) for output devices on gaming or mobile devices 108 and 128 when the player 112 plays a selected game and the preferences can be used to generate and provide media content associated with those preferences to nearby gaming or mobile devices 108 and 128. The gaming server 116 may be configured to generate and transmit media content messages to appropriate or selected ones of the gaming or mobile devices 108 and 128 within the common or selected area to provide the media content substantially simultaneously over a common time interval coinciding with the player 112 playing one or more of the gaming or mobile devices or otherwise being in or near the common or selected area within the casino.

In some embodiments, the gaming server 116 may be configured to determine game information associated with a game being played by a player 112 or multiple players 112 in a casino environment (e.g., within a common or selected area or on a casino floor) and may customize outputs produced by the gaming devices 108 within the common or selected area based on the gaming information and based on event-related signals received by the gaming server 116 from gaming or mobile devices 108 and 128. As a non-limiting example, the gaming information associated with the game being played by the player or player(s) 112 can be used to generate and provide media content not only to the gaming or mobile device 108 and 128 being played but also to nearby gaming or mobile devices 108 and 128. The gaming server 116 may be configured to generate and transmit media content messages to appropriate or selected ones of the gaming or mobile devices 108 and 128 within the common or selected area to provide the media content substantially simultaneously over a common time interval coinciding with the player 112 playing one or more of the gaming or mobile devices.

In some embodiments, the gaming server 116 may be configured to determine device information associated with a gaming or mobile device 108 and 128 in a casino environment (e.g., within a common or selected area or on a casino floor) and may customize outputs produced by the gaming devices 108 within the common or selected area based on the device information and based on event-related signals received by the gaming server 116 from gaming or mobile devices 108 and 128. As a non-limiting example, the device information can be used to generate and provide media content not only to the gaming or mobile device 108 and 128 associated with the device information but also to nearby gaming or mobile devices 108 and 128. The gaming server 116 may be configured to generate and transmit media content messages to appropriate or selected ones of the gaming or mobile devices 108 and 128 within the common or selected area to provide the media content substantially simultaneously over a common time period coinciding with the associated gaming or mobile device 108 or 128.

A gaming device 108 may include any type of known gaming device such as a slot machine, a table game, an electronic table game (e.g., video poker), a skill-based game, etc. The gaming device 108 can be in the form of an EGM, ETG, virtual gaming device, video game gambling machine, etc.

The gaming server 116 can be in communication with one or more databases 124 containing player information, game information, or device information. A player information field may be used to store any type of information that identifies or is associated with a player 112. In some embodiments, the player information field may store one or more of username information for a player 112, contact information for a player (such as email address, phone number, social website webpage universal resource locator, and the like), password information for a player account, player status information, accommodations associated with the player 112, award history (e.g., when such awards were granted to the player 112, whether the awards have been redeemed, and whether the awards are being funded by a game of chance or skill), player preferences for output devices (e.g., video and audio settings) and any other type of customer service management data that may be stored with respect to a player 112. The game information field may be used to store information associated with an active game, including associated rule sets to be played on a gaming or mobile device 108 and 128, game play state, timer value associated with a game activity (e.g. wagering, etc.), game outcome, award history for a game being played (e.g., score, player level, awards, bonuses, mini bonuses, jackpots, side bets, etc.), and other type of information related to a game.

The device information field may be used to store any type of information associated with a gaming or mobile device 108 or 128 including award history for the device (e.g., awards, bonuses, mini bonuses, jackpots, side bets, etc., and when such awards were granted), a state or mode of the gaming or mobile device 108 and 128 (e.g., a play mode, idle mode, attract mode, error mode, or offline mode), a change in odds associated with a potential selected outcome of a game on the gaming or mobile device (such as a gaming device having an increased likelihood of a winning outcome sensed by metering or some other system), a network or other identification of the gaming or mobile device, contact information of the gaming or mobile device, and a spatial location of the gaming or mobile device with respect to a common or selected area. As will be appreciated, the information in the database(s) 124 can be used not only to identify a sensed event triggering generation and transmission of media content messages to cause provision of a media content presentation by multiple target gaming devices but also to customize the media content for specific applications.

In some embodiments, the gaming server 116 may utilize one or more databases 124 to track player 112 activity with respect to the gaming devices 108. For instance, if the gaming server 116 corresponds to a PTS, then games played at the gaming devices 108, credits wagered in a slot game, credits won in a slot game, etc. may correspond to the types of first player 112 activities tracked by the gaming server 116. The gaming server 114 may utilize different databases to detect sensed events and track outcomes of sensed events, locations of players 112 within a casino and the wagers placed by those players 112, etc. The database can be any centralized or distributed system for storing information as an organized collection of data. While not shown, the database can have a database management system that interacts with other entities, applications, and the database itself to capture and analyze the data. The data can be organized using any database model, including relational or non-relational, hierarchical, network, object-oriented, object-relational, entity-relationship, NoSQL, or other database model.

Gaming Device

Figure 2:
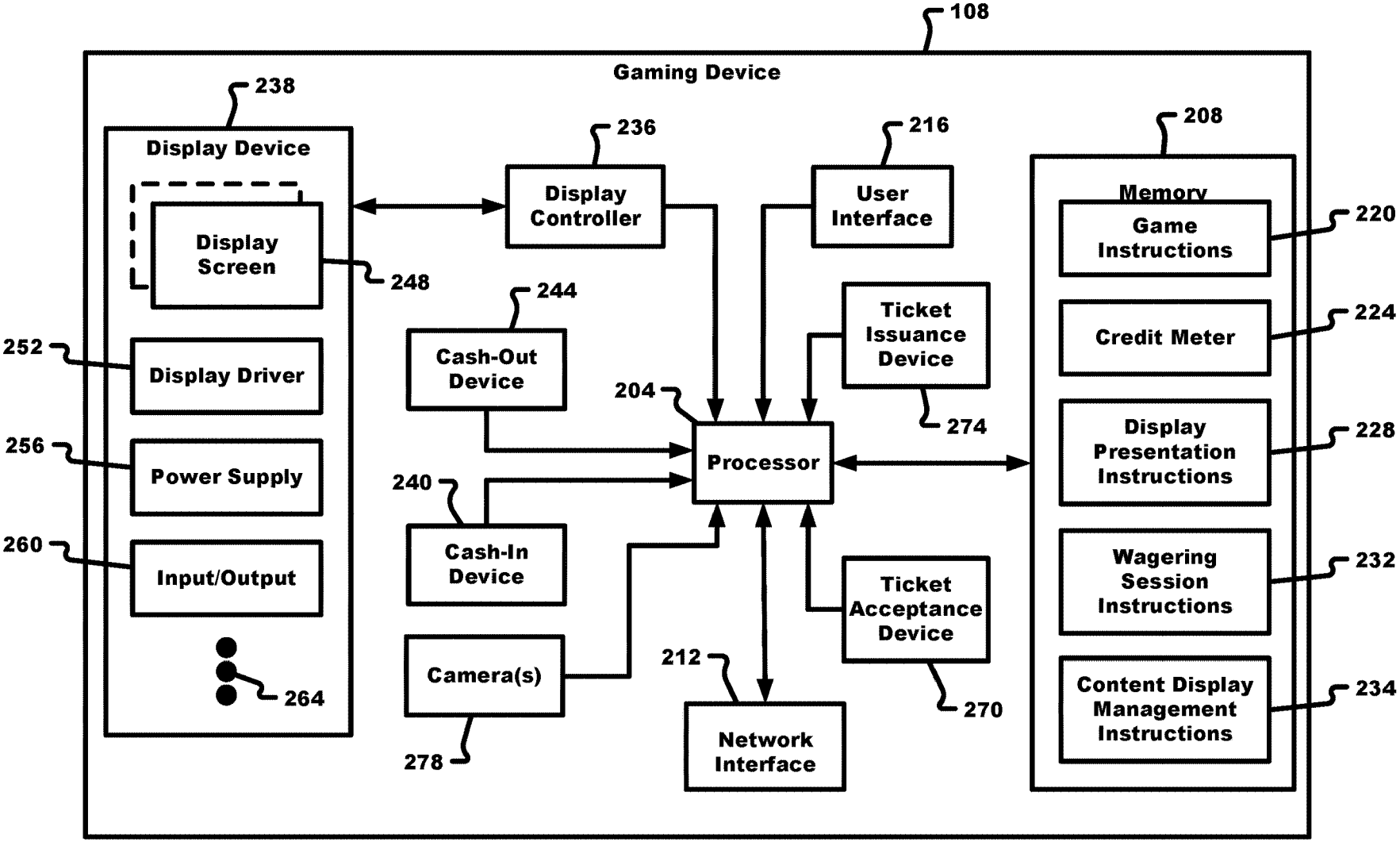
FIG. 2 is a block diagram depicting details of a gaming device in accordance with at least some embodiments of the present disclosure.

With reference now to FIG. 2, additional details of a gaming device 108 will be described in accordance with at least some embodiments of the present disclosure. While depicted as a gaming device 108, it should be appreciated that some or all of the components of a single gaming device 108 may be distributed across multiple gaming devices 108 (of the same or different type) without departing from the scope of the present disclosure.

The gaming device 108 is depicted to include a processor 204, memory 208, a network interface 212, a user interface 216, a display controller 236, a display device 238, a cash-in device 240, a cash-out device 244, a ticket acceptance device 270, a ticket issuance device 274, and one or more cameras 278. In some embodiments, the processor 204 may correspond to one or many microprocessors, CPUs, microcontrollers, or the like. The processor 204 may be configured to execute one or more instruction sets stored in memory 208.

The nature of the network interface 212 may depend upon whether the network interface 212 is provided in a gaming device 108 or a mobile device 128. In some embodiments, the network interface 212 may include at least one port that facilitates a physical connection and data connection with the communication network 104. Non-limiting examples of a suitable network interface 212 include, without limitation, an Ethernet port, a USB port, an RS-232 port, an RS-485 port, a NIC, an antenna, a driver circuit, a modulator/demodulator, etc. The network interface 212 may include one or multiple different network interfaces depending upon whether the gaming device 108 is connecting to a single communication network 104 or multiple different types of communication networks 104. For instance, the gaming device 108 may be provided with both a wired network interface and a wireless network interface without departing from the scope of the present disclosure. In some embodiments, the network interface 212 may include different communications ports that interconnect with various input/output lines. By way of non-limiting example, a first communications port may provide an interconnection (e.g., via at least one Ethernet, RJ-11, RJ-45, or other communications port) between the network interface 212 and the gaming server 116, or other servers in the gaming system 100. Continuing this example, a second communications port of the network interface 212 may provide an interconnection between the network interface 212 and the gaming server 116. The network interface 212 may further include a third communication port that provides connectivity with the game management system 116. In this manner, the gaming device 108 may allow for the transfer of information from one or more of the servers 116.

The user interface 216 may correspond to any type of input and/or output device that enables the player 112 to interact with the gaming device 108. As can be appreciated, the nature of the user interface 216 may depend upon the nature of the gaming device 108. For instance, if the gaming device 108 includes a slot machine game, then the user interface 216 may include one or more reels, or virtual rendered reels, with symbols provided thereon, one or more lights or LED displays, one or more depressible buttons, a lever or "one armed bandit handle," a speaker, or combinations thereof. If the gaming device 108 is a digital or mobile device, then the user interface 216 may include one or more touch-sensitive displays, LED/LCD display screens, buttons, switches, etc.

The memory 208 may include one or multiple computer memory devices that are volatile or non-volatile. The memory 208 may be configured to store instruction sets that enable player 112 interaction with the gaming device 108, that enable game play at the gaming device 108, that enable viewing of media content at the gaming device 108, that enable coordination with the gaming server 116, and that enable other enhanced presentation functions to be provided at the gaming device 108. Non-limiting examples of instruction sets that may be stored in the memory 208 include a game instruction set 220, a credit meter 224, a display presentation instruction set 228, a wagering session instruction set 232, and a content management instruction set 234. It should be appreciated that the instruction sets depicted in FIG. 2 may be combined (partially or completely) with other instruction sets or may be further separated into additional and different instruction sets, depending upon configuration preferences for the gaming device 108. Said another way, the particular instruction sets depicted in FIG. 2 should not be construed as limiting embodiments described herein.

In some embodiments, the game instructions 220, when executed by the processor 204, may enable the gaming device 108 to facilitate one or more games of chance or skill and produce interactions between the player 112 and the game of chance or skill. In some embodiments, the game instructions 220 may include subroutines that present one or more graphics to the player 112 via the user interface 216, subroutines that calculate whether a particular game wager has resulted in a win or loss during the game of chance or skill, subroutines for determining payouts for the player 112 in the event of a win, subroutines for exchanging communications with a connected server (e.g., gaming server 116 or the like), subroutines for enabling the player 112 to engage in a game using their mobile device 128, and any other subroutine or set of instructions that facilitate gameplay at or in association with the gaming device 108.

The credit meter 224 may correspond to a data structure within the gaming device 108 that facilitates a tracking of activity at the gaming device 108. In some embodiments, the credit meter 224 may be used to store or log information related to various player 112 activities and events that occur at the gaming device 108. The types of information that may be maintained in the credit meter 224 include, without limitation, player information, available credit information, wager amount information, and other types of information that may or may not need to be recorded for purposes of accounting for wagers placed at the gaming device 108 and payouts made for a player 112 during a game of chance or skill played at the gaming device 108. In some embodiments, the credit meter 224 may be configured to track coin-in activity, coin-out activity, coin-drop activity, jackpot paid activity, bonus paid activity, credits applied activity, external bonus payout activity, ticket/voucher in activity, ticket/voucher out activity, timing of events that occur at the gaming device 108, and the like. In some embodiments, certain portions of the credit meter 224 may be updated in response to outcomes of a game of chance or skill played at the gaming device 108 and/or in response to occurrences or outcomes of incidents associated with events the player 112 bet on at the gaming device 108 as part of a wagering session. In some embodiments, the credit meter 224 may be updated depending upon whether the gaming device 108 is issuing a ticket/voucher, being used as a point of redemption for a ticket/voucher, and/or any other activity associated with a ticket/voucher. Some or all of the data within the credit meter 224 may be reported to the gaming server 116, by way of non-limiting example, if such data applies to a centrally-managed game and/or a status of a ticket/voucher. As a non-limiting example, the number, value, and timing of wagers placed by a particular player 112 and payouts on such wagers may be reported to the gaming server 116.

The display presentation instruction set 228, when executed by the processor 204, may enable the gaming device 108 to provide various display and/or auditory presentations for a game played on the gaming device 108. The display presentation instruction set 228 may also be configured to produce particular outputs with output devices of the gaming device 108 based on media content messages received and processed by the content display management instruction set 234. For instance, based on a sensed event, the content display management instruction set 234 may receive a media content message from an external device (e.g., another gaming device 108 or the gaming server 116). In response to receiving the media content message, the content display management instruction set 234 may determine desired outputs to be produced at the gaming device 108 and such information may be communicated to the display presentation instruction set 228. The display presentation instruction set 228 may be configured to produce one or more outputs that cause the user interface 216 and/or display device 238 to generate an audible and/or visible output for the player 112. Said another way, the display presentation instruction set 228 may render one or more alerts, alarms, winning graphics, flashing lights, losing graphics, etc. in accordance with data received in one or more media content messages. As will be discussed in further detail herein, because such media content messages may be generated and transmitted in response to sensed events in a casino, the gaming device 108 is enabled to enhance the player 112 experience associated with the such sensed events. The display presentation instruction set 228 may provide one or more commands to the display controller 236 and the display device 238 to control the rendered output throughout a player's 112 interaction, and/or wagering session, with the gaming device 108.

In some embodiments, the content display management instruction set 234 comprises a set of display requirement rules that, in certain situations, override a received media content message. More specifically, and without limiting embodiments described herein, the set of display requirement rules can include: when the selected gaming device is performing a first action, the selected gaming device displays the selected media content; but when the selected gaming device is performing a different second action, the selected gaming device displays media content different from the selected media content. The second action can be not only restrictions caused by interaction with a player 112 but also requirements arising from governing statue, law, regulation, or other legal or operator requirement. In certain situations, one or more display devices is required to provide preselected content, such as player warnings, advisory messages, or other required media content.

The wagering session instruction set 232, when executed by the processor 204, may enable the gaming device 108 to receive input from a player 112 (e.g., via the user interface 216, etc.) placing a bet on an outcome associated with a game. The wagering session instruction set 232 may command the one or more cameras 278 of the gaming device 108 to take at least one image of the player 112 placing the bet (e.g., to confirm that the player 112 is authorized to place the bet, etc.). The wagering session instruction set 232 may work in conjunction with the display presentation instruction set 228 to render betting information (e.g., wagering opportunities, odds, etc.) to a display device 238 of the gaming device 108.

The gaming device 108 may include one or more display devices 238 configured to render information, live video, communications windows, wagering interface windows, games, interactive elements, and/or other visual output to one or more display screens 248. The gaming device 108 may include one or more display controllers 236 configured to control an operation of the display device 238. This operation may include the control of input (e.g., player 112 input via the user interface 216, command input via the instruction sets in memory 208, combinations thereof, etc.), output (e.g., display, rendered images, visual game behavior, etc.) and/or other functions of the display device 238.

The display device 238 may one or more display screens 248 that are configured to selectively activate pixels and/or display elements to render one or more games, windows, indicators, interactive elements, icons, characters, lights, images, etc. Non-limiting examples of the display screen 248 may include, but are in no way limited to, a liquid crystal display (LCD), a light-emitting diode (LED) display, an electroluminescent display (ELD), an organic LED (OLED) display, and/or some other two-dimensional and/or three-dimensional display. In some embodiments, the one or more display screens 248 may be separated into a main display and a secondary display.

The display device 238 may include a display driver 252, a power supply 256, an input/output 260, and/or other components 264 configured to enable operation of the display device 238. The display driver 252 may receive commands and/or other data provided by the processor 204 and one or more of the instruction sets in memory 208. In response to receiving the commands, the display driver 252 may be configured to generate the driving signals necessary to render the appropriate images to the display screen 248. The power supply 256 may provide electric power to the components of the display device 238. In some embodiments, the power supply 256 may include a transformer and/or other electronics that prevent overloading, condition power signals, and/or provide backup power to the display device 238. The input/output 260 may correspond to one or more connections for receiving or exchanging information and/or video from components of the gaming device 108. The input/output 260 may include an interconnection to the network interface 212. By way of non-limiting example, the input/output 260 may include a high-definition multimedia interface (HDMI) input, Ethernet, composite video, component video, H.264, or other video connection.

The cash-in device 240 may include a bill acceptor, a coin acceptor, a chip acceptor or reader, or the like. In some embodiments, the cash-in device may also include credit card reader hardware and/or software. The cash-out device 244, like the ticket issuance device 274, may operate and issue cash, coins, tokens, or chips based on an amount indicated within the credit meter 224. In some embodiments, the cash-out device 244 may include a coin tray or the like and counting hardware configured to count and distribute an appropriate amount of coins or tokens based on a player's 112 winnings or available credit within the credit meter 224.

Because the gaming device 108 may be used for the acceptance and issuance of tickets/vouchers, the gaming device 108 may be provided with appropriate hardware to facilitate such acceptance and issuance. Specifically, the gaming device 108 may be provided with a ticket acceptance device 270 that is configured to accept or scan physically-printed tickets/vouchers and extract appropriate information therefrom. In some embodiments, the ticket acceptance device 270 may include one or more machine vision devices (e.g., a camera, IR scanner, optical scanner, barcode scanner, etc.), a physical ticket acceptor, a shredder, etc. The ticket acceptance device 270 may be configured to accept physical tickets and/or electronic tickets without departing from the scope of the present disclosure. An electronic ticket/voucher may be accepted by scanning a one-dimensional barcode, two-dimensional barcode, or other type of barcode or quick response (QR) code displayed by a player's 112 mobile device, by way of non-limiting example.

The ticket issuance device 274 may be configured to print or provide physical tickets/vouchers to players 112. In some embodiments, the ticket issuance device 274 may be configured to issue a ticket/voucher consistent with an amount of credit available to a player 112, possibly as indicated within the credit meter 224.

The gaming device 108 may include at least one camera 278, or image capture device, that is configured to capture still and/or video images in proximity to the gaming device 108. The camera 278 may include, or be associated, with additional devices, such as light sources, flashes, infrared emitters, etc., to provide a clear image capture environment. As provided herein the camera 278 may be controlled by the processor 204 in conjunction with signals from the wagering session instruction set 232 and/or other instruction sets in memory 208.

Gaming Server

Figure 3:
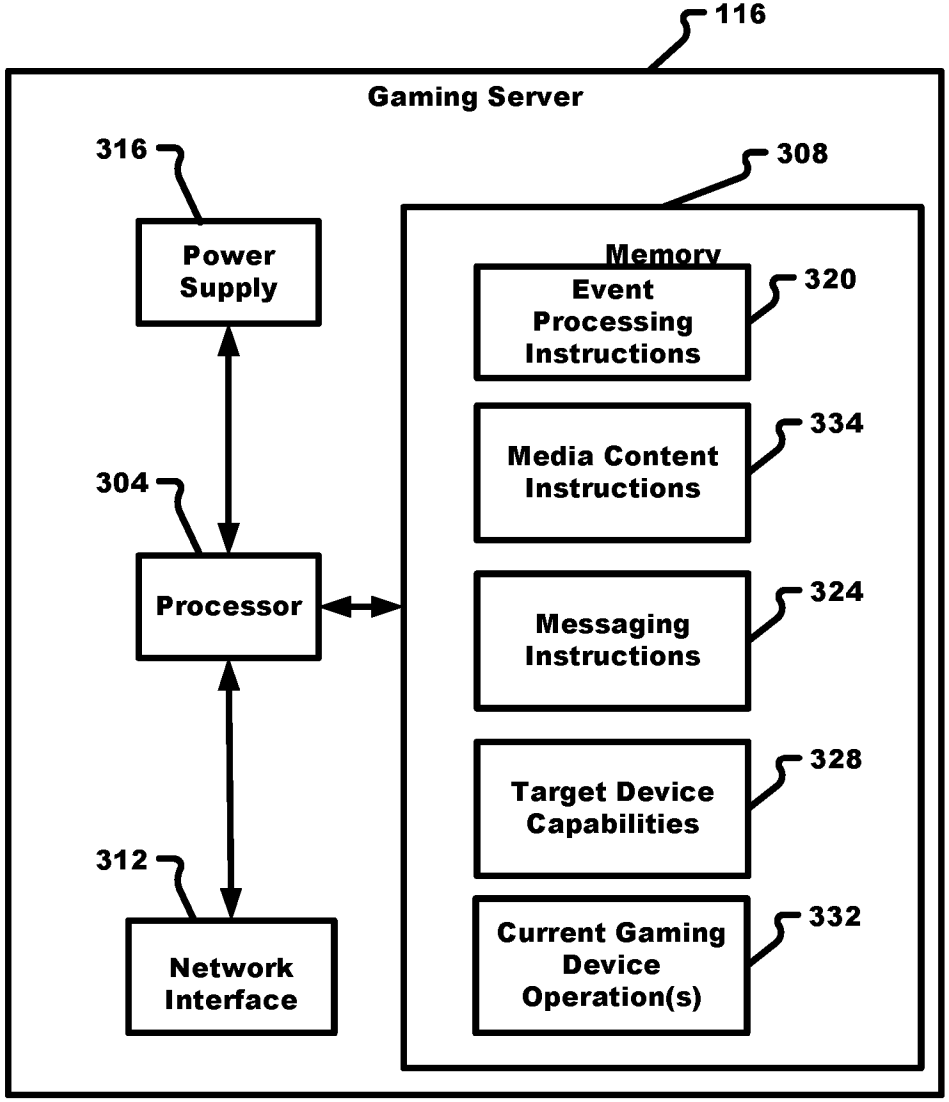
FIG. 3 is a block diagram depicting details of a gaming server in accordance with at least some embodiments of the present disclosure.

With reference now to FIG. 3, additional details of a gaming server 116 will be described in accordance with at least some embodiments of the present disclosure. The gaming server 116 is shown to include a processor 304, memory 308, and a network interface 312. These resources may enable functionality of the gaming server 116 as will be described herein. For instance, the network interface 312 provides the gaming server 116 with the ability to send and receive communication packets or the like over the communication network 104. The network interface 312 may be provided as a network interface card (NIC), a Slot Machine Interface Board (SMIB), a network port, a data port, a modem, drivers for the same, combinations thereof, and the like. Communications between the components of the server 116 and other devices connected to the communication network 104 may all flow through the network interface 312. For instance, media content messages may flow into and out of the network interface 312.

The processor 304 may correspond to one or many computer processing devices. For instance, the processor 304 may be provided as silicon, as a Field Programmable Gate Array (FPGA), an Application-Specific Integrated Circuit (ASIC), any other type of Integrated Circuit (IC) chip, a collection of IC chips, or the like. As a more specific non-limiting example, the processor 304 may be provided as a microprocessor, Central Processing Unit (CPU), or plurality of microprocessors that are configured to execute the instructions sets stored in memory 308. Upon executing the instruction sets stored in memory 308, the processor 304 enables various functions of the gaming server 116.

The memory 308 may include any type of computer memory device or collection of computer memory devices and may be volatile or non-volatile. Non-limiting examples of memory 308 include Random Access Memory (RAM), Read Only Memory (ROM), flash memory, Electronically-Erasable Programmable ROM (EEPROM), Dynamic RAM (DRAM), etc. The memory 308 may be configured to store the instruction sets depicted in addition to temporarily storing data for the processor 304 to execute various types of routines or functions.

The memory 308 may store various data and instruction sets that allow the gaming server 116 to provide multimedia synchronization capabilities between various gaming and mobile devices 108 and 128 with respect to sensed events. Non-limiting examples of such sensed events that may be subject to processing by the gaming server 116 include any type of wagerable event. As provided above, information regarding these sensed event(s) may be received from a gaming or mobile device 108 or by some other mechanism. Other non-limiting examples of sensed events include player information relating to an identified player of a gaming device (such as a player ranking, winning history, preferences, etc.), gaming information relating to a game being played on a gaming device (such as a game outcome or state (e.g., score, award, winnings, or bonus or proficiency level) and the like), and device information associated with a gaming or mobile device 108 and 128 (such as a state or mode of the gaming device (e.g., an in play mode, idle mode, attract mode, error mode, or offline mode), a change in odds associated with an outcome of a gaming device (e.g., a gaming device having an increased likelihood of a winning outcome sensed by metering or some other system), sensed player or potential player activity in spatial proximity to a gaming device, and association of the gaming or mobile devices 108 and 128 with one another to participate in a common game or game-related activity (such as in a game involving multiple gaming devices (e.g., community bonus game or "Big Bertha" multi-reel slot machine in which display output of each gaming device corresponds to a different reel)). Sensed events may correspond to one or more actions or activities that occur at a gaming device 108 (e.g., ticket-in events, win events, wager events, etc.). Events can also arise from changes in sensed player, gaming and/or device information, which changes can also be a trigger for the generation and transmission of media content messages to multiple gaming and mobile devices 108 and 128. Such changes can be associated with a common or a different gaming device.

Illustrative instruction sets that may be stored in memory 308 include, without limitation, an event processing instruction set 320, a media content instruction set 334, and a messaging instruction set 324. The memory 308 may also be configured to store data related to target gaming device capabilities 328 and current gaming device operation(s) 332. Such information may be stored in a table format, in a database format, in a list format, or combinations thereof. Functions of the gaming server 116 enabled by these various instruction sets will be described in further detail herein. It should be appreciated that the instruction sets depicted in FIG. 3 may be combined (partially or completely) with other instruction sets or may be further separated into additional and different instruction sets, depending upon configuration preferences for the gaming server 116. Said another way, the particular instruction sets depicted in FIG. 3 should not be construed as limiting embodiments described herein.

The event processing instruction set 320 may correspond to an instruction set that when executed by the processor 304 enables the gaming server 116 to receive and process various messages received at the network interface 312. In some embodiments, the event processing instructions 320 may be configured to receive one or more messages describing an event, wagers placed on an event, or an outcome of an event. Such messages may be received via the communication network 104 and may have been transmitted by a gaming device 108 and/or by the mobile device 128. The event processing instructions 320 may be configured to process event-related signals received at the network interface 312 and identify a particular occurrence of an event based on the processing of the event-related signals. Information regarding the particular occurrence of an event may then be transferred to the media content and messaging instruction sets 334 and 324 for further processing.

The media content instruction set 334 may be configured to select predetermined media content or generate new media content based on the particular occurrence of a sensed event identified by the event processing instruction set 320. In some embodiments, the media content instruction set 334 may be configured not only to identify particular media content for presentation but also a target set of multiple gaming or mobile devices 108 and 128 or other type of gaming device (collectively "target gaming devices") to present the media content via respective output device(s). Upon receiving the selected media content and identified target set of gaming or mobile devices 108 and 128, the messaging instruction set 324 may cause the media content message(s) for each member target gaming device in the target set to be generated and transmitted to the identified member devices via the network interface 312. As discussed herein, the media content message(s) may enable the recipient target gaming device (e.g., the target gaming device) to perform one or more actions (e.g., produce one or more visible, tactile, and/or audible outputs) consistent with the media content and associated instructions included in the media content message. In some embodiments, the media content message(s) may include specific actions to be performed by a gaming or mobile device, specific timings for such actions, etc.

In some embodiments, the media content instruction set 334 may be configured to generate a generic or common media content message for transmission to multiple target gaming devices (e.g., for transmission via a broadcast capability). Upon receiving a generic media content message, each recipient target gaming device may make a self-determination of an action to perform based on receiving the generic media content message and based on its own knowledge of its respective output device capabilities.

In some embodiments, the media content message payload sent to each target gaming device is different from the media content message payloads sent to other target gaming devices. The differences can arise from the nature of the presentation itself, the nature of the sensed event, and/or different output device capabilities of the target gaming devices. The media content instruction set 334 may utilize the output device capabilities stored, for each target gaming device, in the target gaming device capabilities 328 to determine, prior to generating and sending a media content message, output devices included in specific target gaming devices. In some embodiments, this knowledge maintained in the target gaming device capabilities 328 may be maintained and updated when new gaming or mobile devices 108 and 128 are installed/commissioned, when gaming devices 108 are updated, when gaming devices 108 are moved, when gaming devices 108 are decommissioned, and/or or otherwise detected in the common or selected area of the casino. The gaming device capabilities 328 may describe specific output capabilities of gaming devices 108 and/or the output devices included in such gaming devices 108. With reference to the gaming device capabilities 328, the media content instruction set 234 may be configured to generate gaming device-specific media content messages that identify a particular output to be provided by a particular gaming device 108. This gaming device-specific media content message may also include a desired timing for the particular output. When coordinating outputs of multipole gaming devices 108, the gaming server 116 may transmit multiple, different, gaming device-specific media content messages to different gaming devices 108 to cause each gaming device 108 to produce different outputs, thereby enhancing the excitement associated with an event in a casino.

In some embodiments, the current gaming device operation(s) 332 are used during execution of the media content instruction or messaging instruction sets 334 and 324, respectively, by the processor 304 to select, from among a larger set of gaming or mobile devices in the common or selected area, the target gaming devices in the target set. By way of non-limiting example, the processor may not select, as a target gaming device, a gaming or mobile device in the common or selected area that is determined to be unavailable, e.g., in play mode, error mode, or offline mode. Alternatively or additionally, the processor may select, as target gaming devices, gaming or mobile devices based on device location, e.g., that are spatially adjacent to one another, such as in a bank of gaming devices 108. Alternatively or additionally, the processor may select, as target gaming devices, gaming or mobile devices having specific target gaming device capabilities consistent with the requirements of the presentation.

Possible System Architectures

Figure 4:
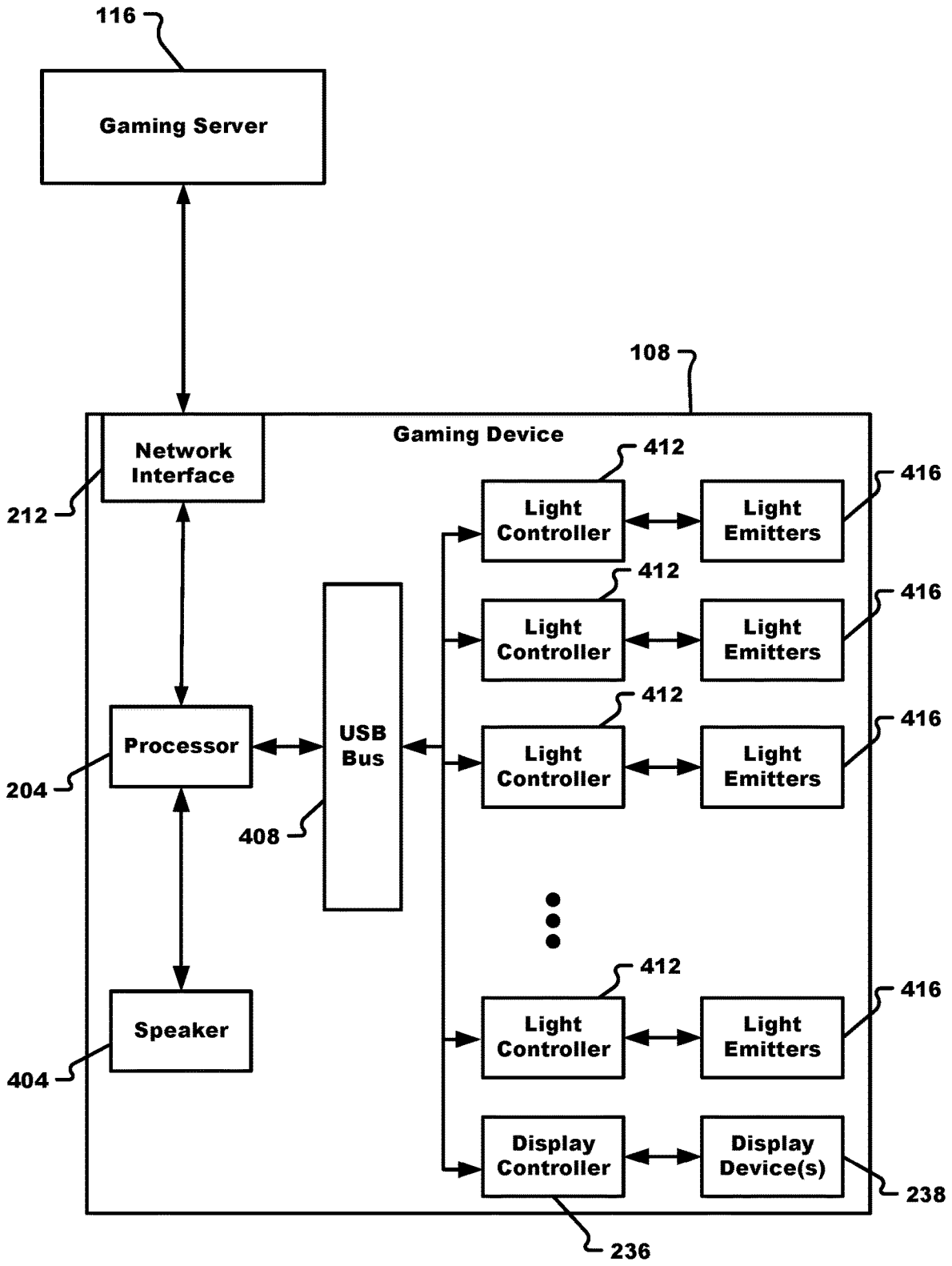
FIG. 4 is a block diagram depicting additional details of a gaming device interacting with a gaming server in accordance with at least some embodiments of the present disclosure.
Figure 5A:
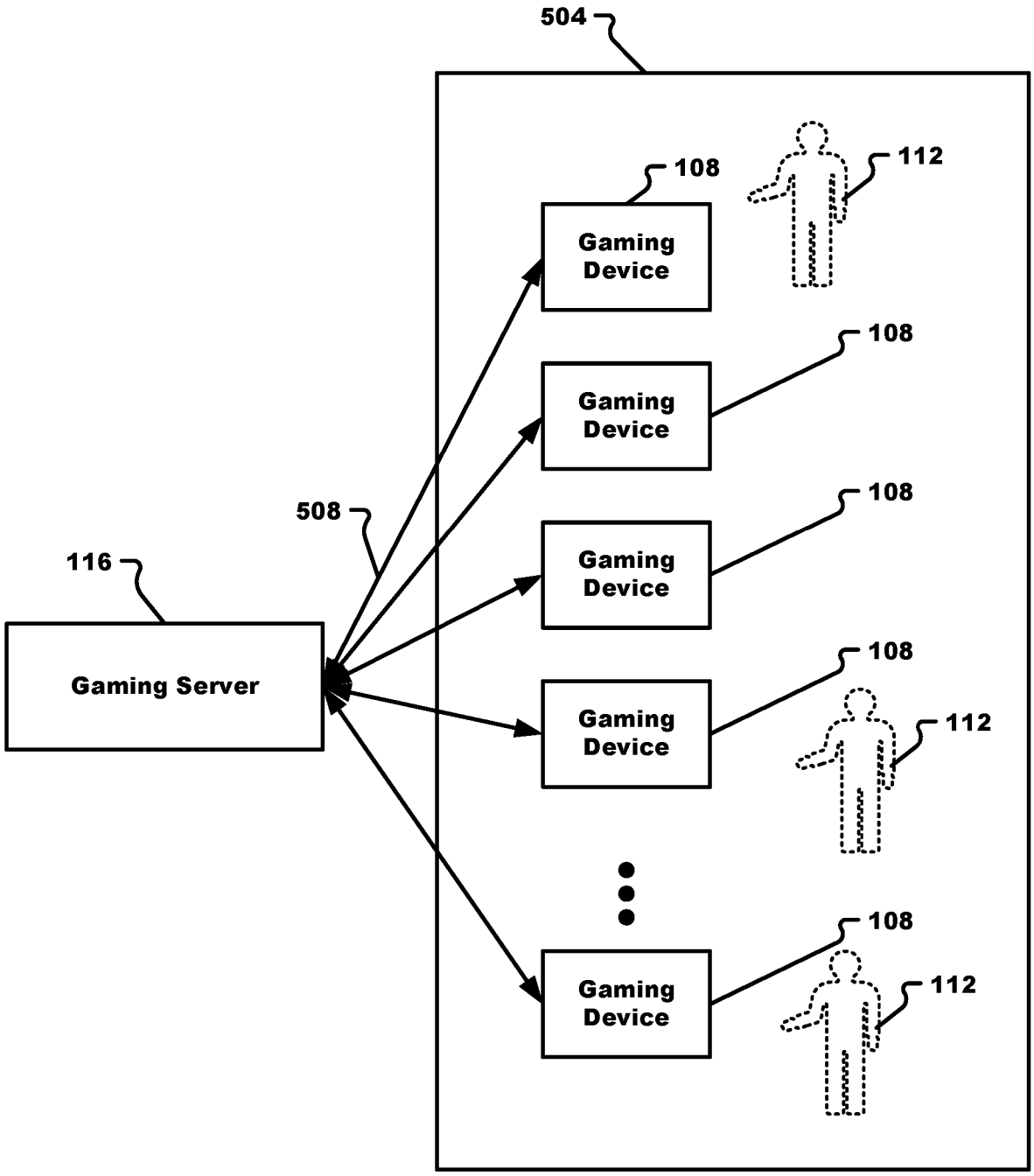
FIG. 5A is a block diagram depicting a gaming server coordinating operations of a plurality of gaming devices in accordance with at least some embodiments of the present disclosure.
Figure 5B:
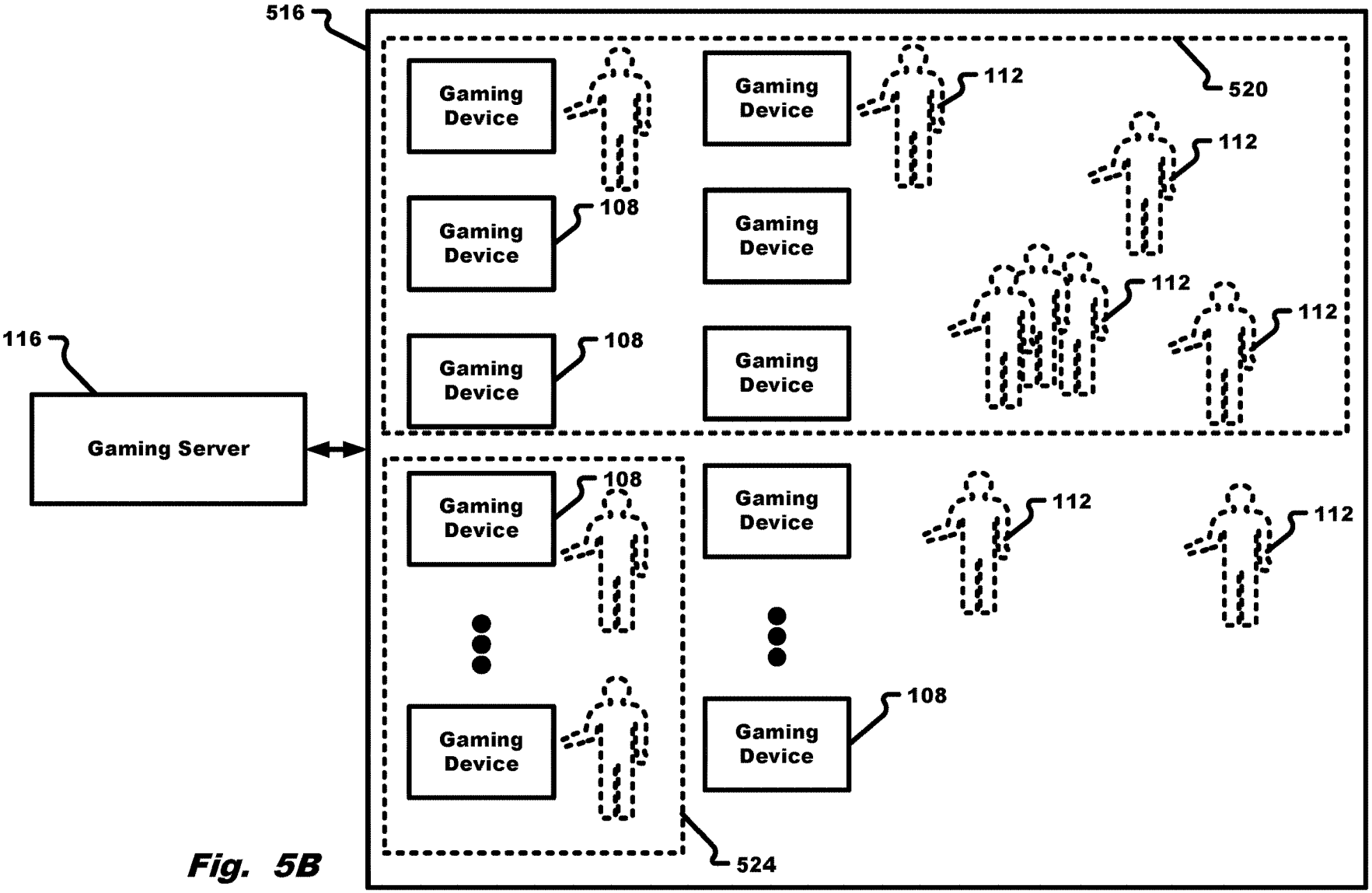
FIG. 5B is a block diagram depicting a gaming server coordinating operations of a plurality of gaming devices in accordance with at least some embodiments of the present disclosure.

With reference now to FIGS. 4, 5A and 5B, additional details of various system 100 architectures will be described in accordance with at least some embodiments of the present disclosure. Referring initially to FIG. 4, additional details of a gaming device 108 and its interactions with a gaming server 116 will be described in accordance with at least some embodiments of the present disclosure.

The gaming device 108 is shown to be in communication with the gaming server 116 via the network interface 212. The processor 204 is connected with a speaker 404 and a plurality of additional output devices (e.g., light emitters 416 and a display device 238) via a serial data bus 408. In the depicted embodiment, the speaker 404 and light emitters 416 may correspond to specific but non-limiting examples of a user interface 216. It should be appreciated that control signaling between the processor 204 and the light emitters 416 may be handled using a protocol native to the serial data bus 408. In some embodiments, the processor 204 may communicate a single command to multiple light controllers 412 to simultaneously cause the light emitters 416 to produce a desired output (e.g., light up or flash at a desired time for a desired duration). The processor 204 can alternatively or additionally cause the speaker 404 to produce an audible output based on a media content message received from the gaming server 116.

In some embodiments, the gaming device 108 is responsive to output commands received from the gaming server 116 in the form of media content messages. The media content messages may be received at the processor 204, processed by the processor 204, and then used to determine which actions should be taken with respect to output devices, namely the speaker 404, light emitters 416, and display device 238. It should be appreciated that the processor 204 may be configured to direct individual commands to particular light emitters 216 based on instructions contained in a media content message. For instance, the processor 204 may cause of the light emitters 416 to emit light of a first color and another of the light emitters 416 to emit light of a second, different, color. Other parameters that may be controlled by the processor 204 include, without limitation, light intensity/brightness, light duration, flashing frequency, timing with which lighting starts and ends, speaker 404 volume, timing of audible sounds produced by the speaker 404, etc. The processor 204 may be configured to control the internal components of the gaming device 108 in accordance with instructions received from the gaming server 116. In some embodiments, a media content message may direct the gaming device 108 to produce a sequence of audible and/or visible outputs via the light emitters 416, display device 238, and speaker 404. The processor 404 may determine the appropriate commands to send to the speaker 404, light controllers 412, and display controller 236 based on the media content message and parameters defined within the media content message. Each output device (e.g., the speaker 404, light emitter(s) 416, and display device 238) may be controlled by the processor 204 to produce an audible and/or visible output that enhances a media content presentation surrounding a sensed event.

FIG. 5 illustrates that a single gaming server 116 may be configured to control multiple gaming devices 108, which may be considered a cluster of gaming devices 504 to the gaming server 116. The cluster of gaming devices 504, in some embodiments, may correspond to a specific bank of gaming devices 108 or the cluster of gaming devices 504 may be dynamically created/selected based on the event in the event-related message. For instance, a player may be playing a particular gaming device 108 and the gaming server 116 may determine to provide a presentation on surrounding gaming devices 108 in the cluster of gaming devices 504 to amplify the player's experience and to encourage other potential players to play a game on a gaming or mobile device. The other gaming devices 108 in the cluster 504 that are spatial proximity with the gaming device in play mode may be controlled to produce a synchronized presentation output. The gaming server 116 may control the cluster of gaming devices 504 in a relatively efficient manner by using a broadcast media content message 508. The broadcast media content message 508 may correspond to a common message transmitted to each gaming device 108 in the cluster of gaming devices 504. Each gaming device 108 in the cluster of gaming devices 504 may utilize their media content instruction set 234 to appropriately respond and produce an output based on the common media content message. It should be appreciated that the outputs produced by each gaming device 108 in the cluster of gaming devices 504 may not necessarily be the same if the output devices of each gaming device 108 are not the same. Said another way, each gaming device 108 may respond to the same broadcast media content message 508 differently based on the capabilities/output devices of each gaming device 108.

FIG. 5B illustrates a further architecture that can be used to control a plurality of gaming device 108 substantially simultaneously in accordance with at least some embodiments of the present disclosure. The architecture depicted in FIG. 5B illustrates a casino floor map 516 that shows a plurality of gaming devices 108 distributed across the map 516 based on the actual location of the gaming devices 108 in a physical casino floor. In this embodiment, a gaming server 116 collects information regarding sensed events at various gaming devices 108. The gaming server 116 can then determine whether certain gaming devices 108 can be clustered to a first cluster of gaming devices 520 or a second cluster of gaming devices 524.

Additionally, the gaming server 116 may have information describing a location of certain gaming devices 108 or clusters of gaming devices 520, 524 relative to a location of a selected player 112 or group of players and this information may also be used to determine which gaming devices 108 should be included in particular gaming device clusters 520, 524 to have the presentation target the player or group of players. For instance, gaming devices 108 that are closer to the selected player or group of players may have their outputs collectively provide substantially simultaneously or synchronously a presentation to increase excitement of the player or group of players and/or to increase a level of engagement of the player or group of players with the gaming device clusters 520 or 524. In this way, different sections of the casino floor can be customized to produce different outputs to match different sensed events involving different gaming devices or different areas of the casino.

Figure 8A:
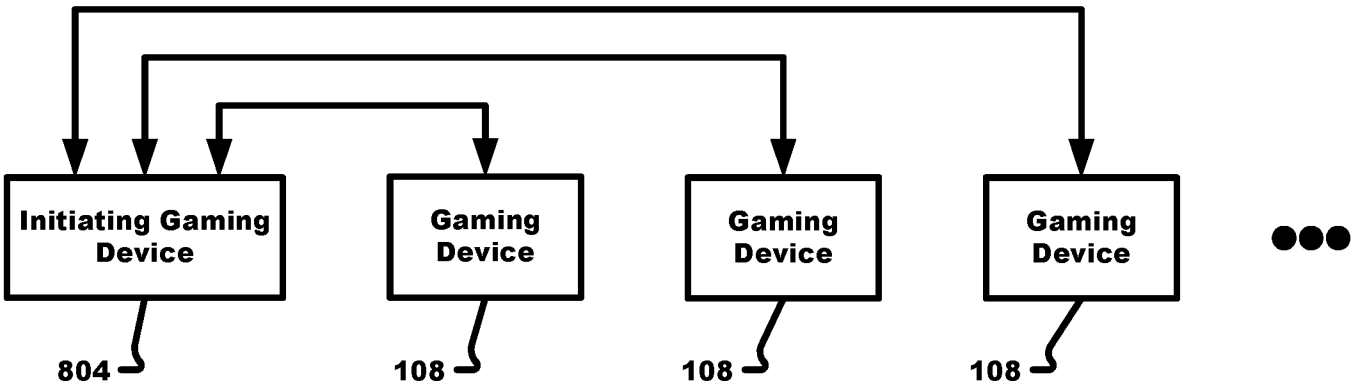
FIG. 8A is a block diagram depicting another alternative system architecture in accordance with at least some embodiments of the present disclosure.
Figure 8B:
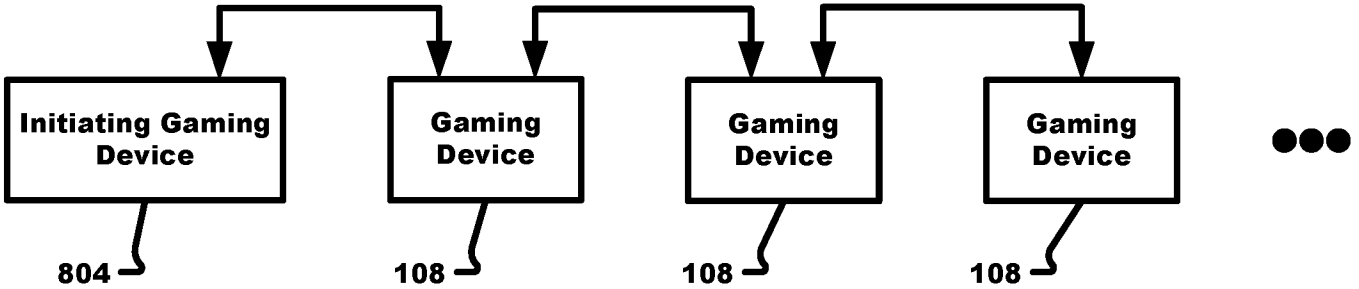
FIG. 8B is a block diagram depicting another alternative system architecture in accordance with at least some embodiments of the present disclosure.

FIGS. 8A and 8B illustrate architectures where one gaming device 108 is operated as an initiating gaming device 804 and other gaming devices 108 are subordinate/slaves to the commands issued by the initiating gaming device 804. In some embodiments, an initiating gaming device 804 may correspond to a gaming device 108 that is being engaged (played) by a player 112. In some embodiments, an initiating gaming device 604 may correspond to a gaming device 108 that is determined to be in proximity with a player 112 that has just won a wager on an event, lost a wager on an event, presented a winning ticket, been issued a winning ticket, won a game of chance, lost a game of chance, etc. In the architecture of FIG. 8A, the initiating gaming device 604 may be configured to generate one or more media content messages and transmit the media content messages (either individually or via a broadcast) to a plurality of other gaming devices 108. The other gaming devices 108 may respond to the media content message, when received, as if the media content message originated from a gaming server 116.

In the architecture of FIG. 8B, the media content message may be serially passed from the initiating gaming device 804 to one other gaming device 108. Each gaming device 108 may pass the media content message along to at least one other gaming device in a daisy chain fashion until the media content message has been distributed to all desired gaming devices 108.

Figure 8C:
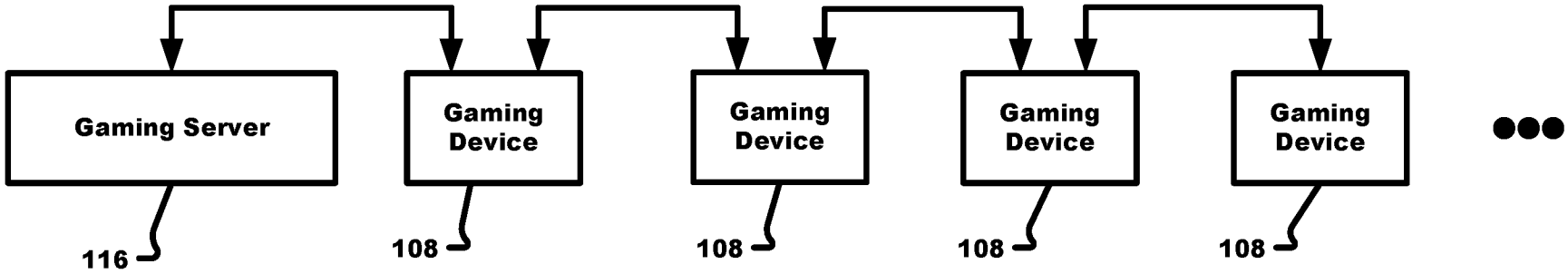
FIG. 8C is a block diagram depicting another alternative system architecture in accordance with at least some embodiments of the present disclosure.

FIG. 8C illustrates an architecture similar to FIG. 8B, except that the media content message does originate from a gaming server 116. In this particular embodiment, the gaming server 116 may communicate with a single gaming device 108 and the single gaming device 108 may transfer the media content message to another (e.g., neighboring gaming device 108) device until all desired gaming devices 108 have received the media content message. As will be described herein, depending upon the architecture, the media content message may be formatted with certain synchronization parameters. For instance, if a media content message is broadcast to a plurality of gaming devices 108, then each gaming device 108 may be configured to produce an output nearly immediately upon receiving the media content message. On the other hand, if an architecture like the ones depicted in FIGS. 8A thru 8C are employed, then the media content message may be formatted with information describing a certain time that each of the gaming devices 108 should produce an output. The certain time may be defined relative to a shared clock or with a defined delay set to begin upon receipt of the media content message.

Presentations

Figure 6A:
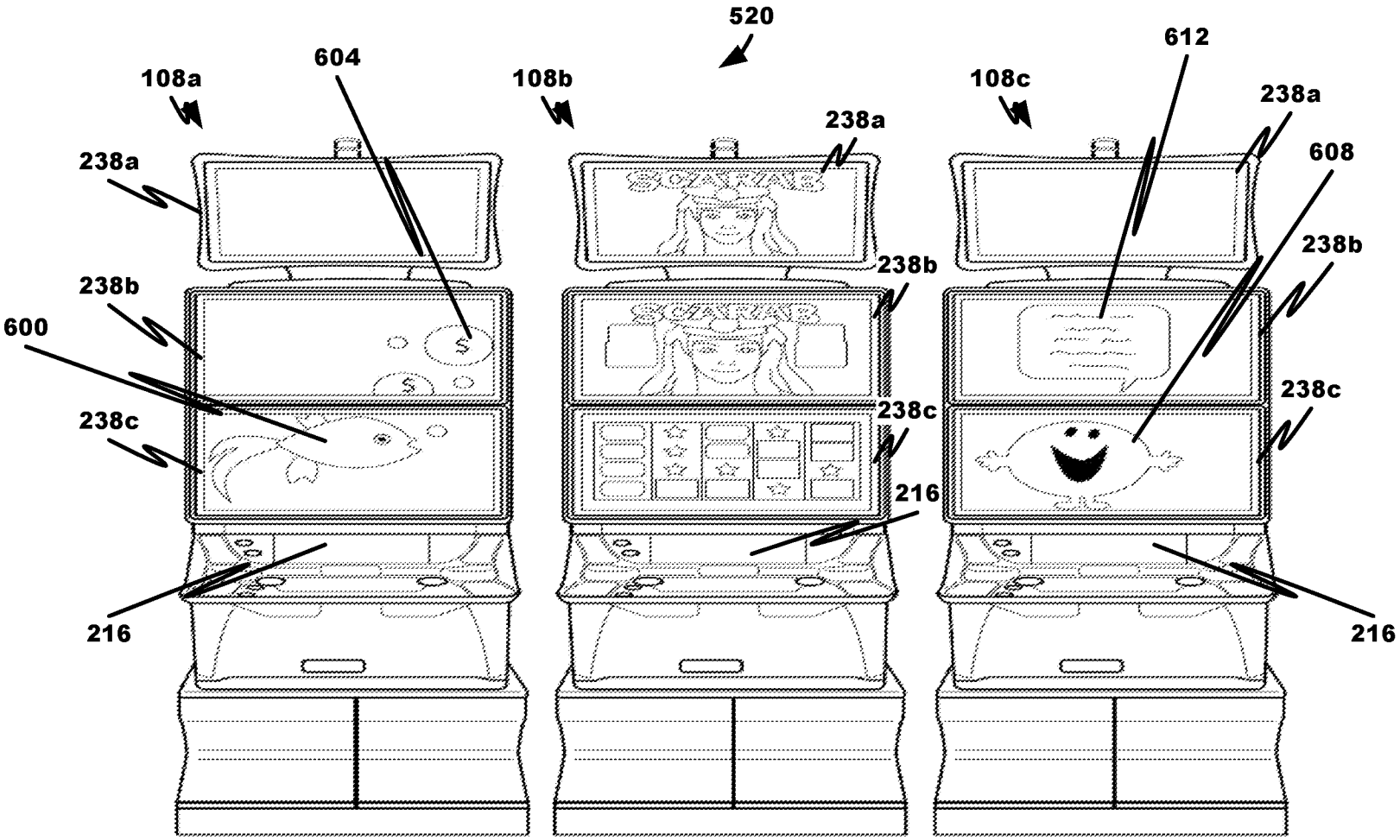
FIG. 6A depicts media content displayed by multiple gaming devices in accordance with at least some embodiments of the present disclosure.

With reference to FIG. 6A, a first exemplary presentation is depicted in connection with a bank 520 of gaming devices 108*a-c*. Each of the gaming devices 108*a-c* comprises first, second, and third display devices 238*a-c* and a user interface 216 (which includes tactile controls and a secondary display device). The second gaming device 108*b* is in a gaming session with a player (not shown). The first, second, and third display devices 238*a-c* of the second gaming device 108*b* display media content associated with the active game and are therefore unable to display media content associated with the presentation. The first and third gaming devices 108*a* and 108*c* are in attract mode and therefore able to display synchronously during game play media content associated with different parts of the presentation. The first, second, and third display devices 238*a-c* of the first gaming device 108*a* display an animated character or object depicted as a fish 600 that moves among the first, second, and third display devices 238*a-c* along a predetermined movement pathway or trajectory. The fish releases other objects shown as bubbles 604 that move upwardly along different predetermined trajectories. The fish and bubbles can interact with the environment and personality of the player 112 or group of players 112. Meanwhile, the third gaming device 108*c* displays on the third display device 238*c* an animated character or object shown as a person 608, and on the second display device 238*b* a speech balloon 612 containing a text equivalent to speech being emitted by the speakers 404 of the third gaming device relating to the gaming session on the second gaming device 108*b*. The person 608 in the example knows that the second gaming device is about to enter a bonus game and interacts with the player 112 by the speech and animation. The spectral output of the light emitters 416 of the first and third gaming devices 108*a* and *c* are synchronized with the presentation. The media content outputs of the first and third gaming devices 108*a* and *c* are substantially synchronized with the sensed events arising from the gaming session on the second gaming device 108*b*. In the cases of all of the gaming devices 108, the presentation temporally uses selected output devices until the gaming device changes mode, such as in response to player interaction. In response to the mode change, the output devices of the affected gaming device cease providing the presentation and are thereafter controlled by the game instruction set executed by the processor of the gaming device. While the bank of gaming devices 520 is discussed with reference only to three gaming devices, it is to be understood that the principles of this disclosure apply to any number of gaming devices in a cluster or bank and apply not only to gaming devices but also to mobile devices and other target gaming devices and combinations thereof.

Figure 6B:
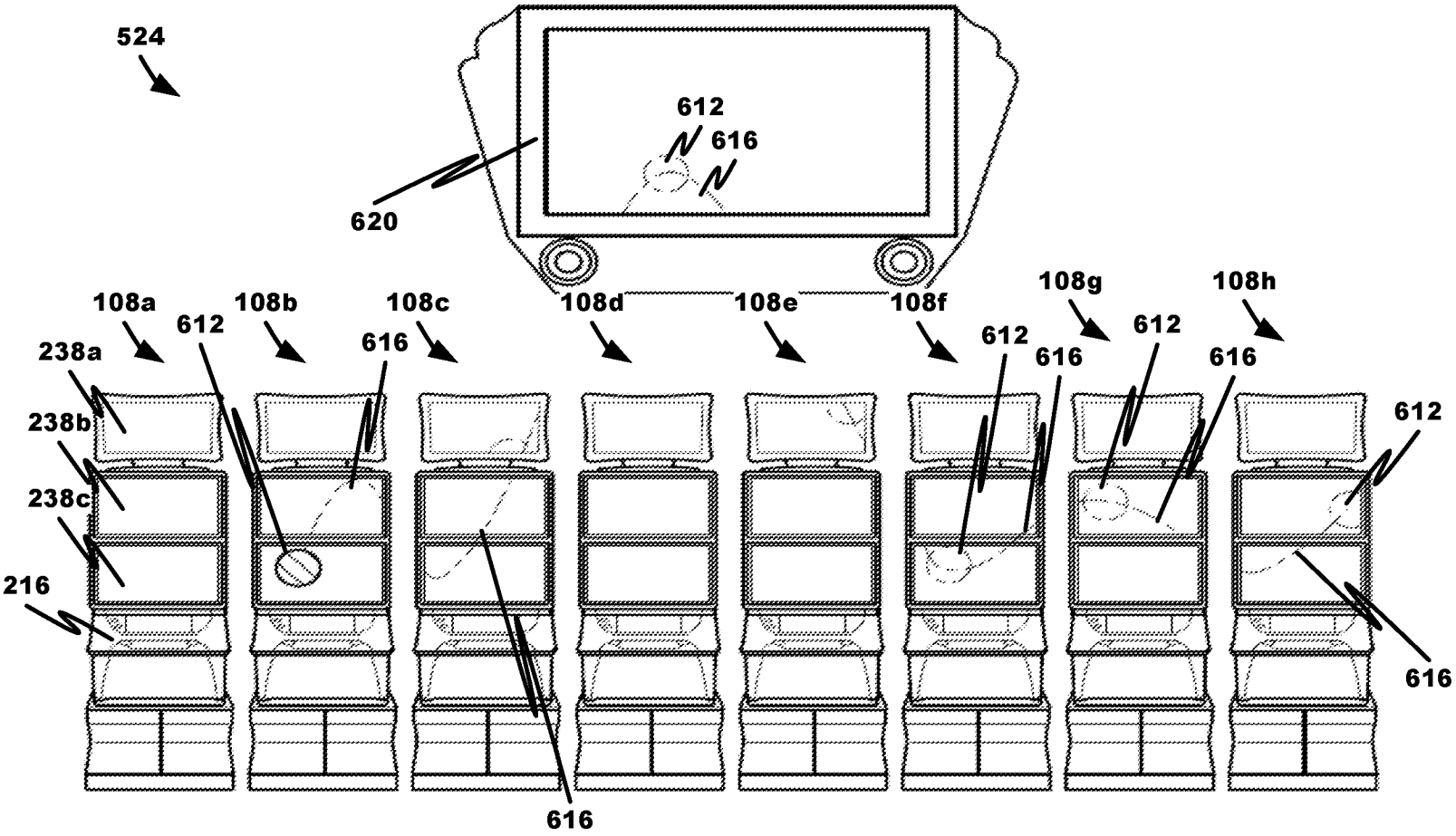
FIG. 6B depicts media content displayed by multiple gaming devices in accordance with at least some embodiments of the present disclosure.

With reference to FIG. 6B, a second exemplary presentation is depicted in connection with a bank 524 of gaming devices 108*a-h*. In the bank 524 of gaming devices 108*a-h*, an object depicted as a ball 612 moves along a movement path or trajectory 616 that traverses multiple display devices 238 of multiple gaming devices 108 as well as a topper display device 620 positioned above the bank 524 of gaming devices 108*a-h*. In the example, all of the gaming devices 108*a-h* in the bank 524 are in an idle or attract mode and therefore have display devices available to display media content associated with a respective part of the presentation. The dashed lines indicate a prior position of the ball 612 during movement from the gaming device 108*h* to its current position at gaming device 108*b*. While the bank of gaming devices 524 is discussed with reference to eight gaming devices, it is to be understood that the principles of this disclosure apply to any number of gaming devices in a cluster and apply not only to gaming devices but also to mobile devices and other target gaming devices and combinations thereof.

Figure 6C:
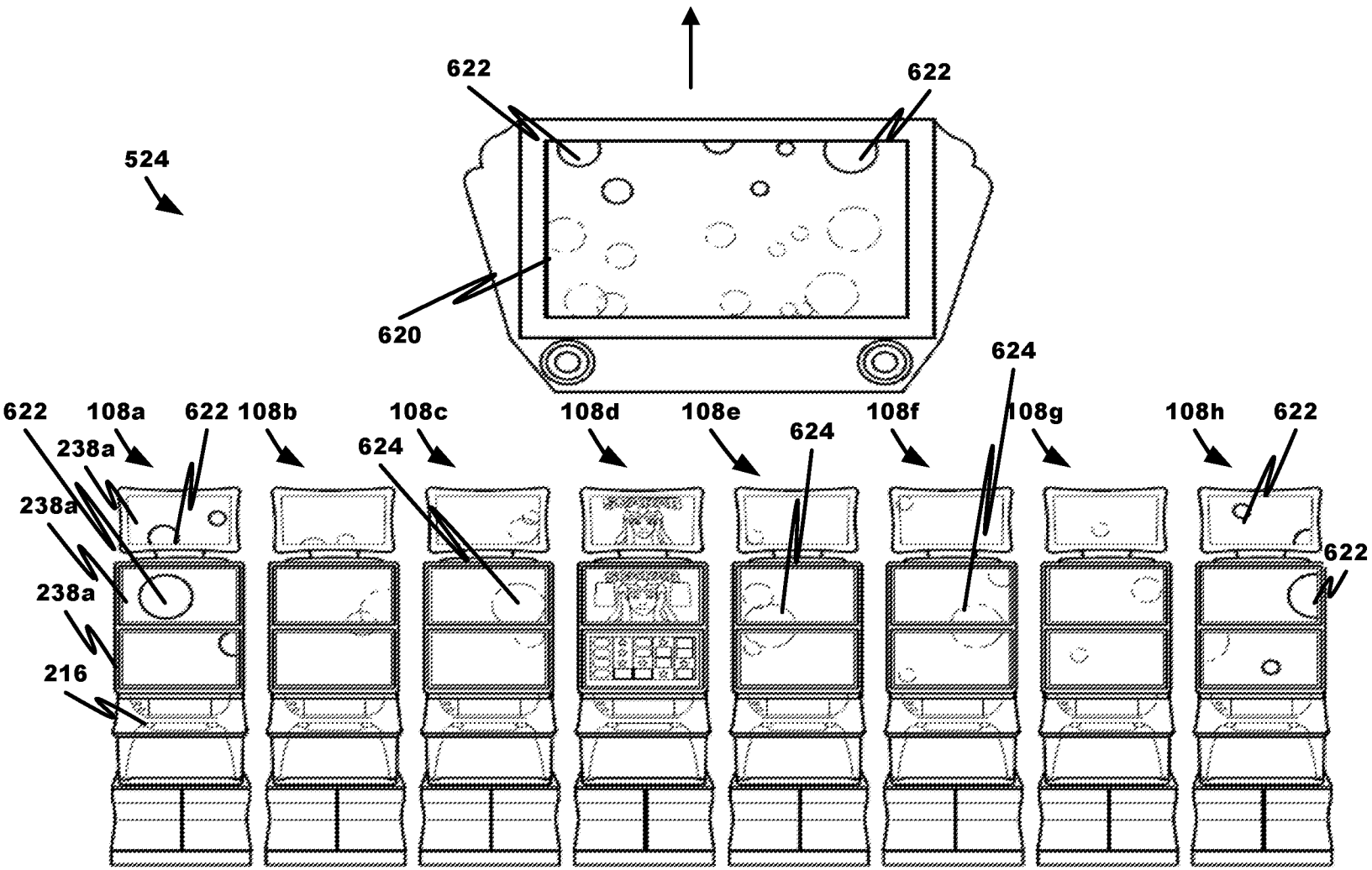
FIG. 6C depicts media content displayed by multiple gaming devices in accordance with at least some embodiments of the present disclosure.

With reference to FIG. 6C, a third exemplary presentation is depicted in connection with the bank 524 of gaming devices 108*a-h*. In the bank 524 of gaming devices 108*a-h*, objects depicted as balls 622 move outwardly from either side of a gaming device 108*d* that is in a play mode with a player. The balls not only move outwardly from the gaming device 108*d* in the directions shown by the arrows and traverse multiple display devices 238 of multiple gaming devices 108*a-c* and 108*e-h* but also move upwardly from the top of the gaming device 108*d* and traverse a topper display device 620 positioned above the bank 524 of gaming devices 108*a-h*. The dashed balls 624 and trajectory represent prior positions of the balls 622 as they move outwardly and upwardly from the gaming device 108*d*. While the bank of gaming devices 524 is discussed with reference to eight gaming devices, it is to be understood that the principles of this disclosure apply to any number of gaming devices in a cluster and apply not only to gaming devices but also to mobile devices and other target gaming devices and combinations thereof.

Figure 6D:
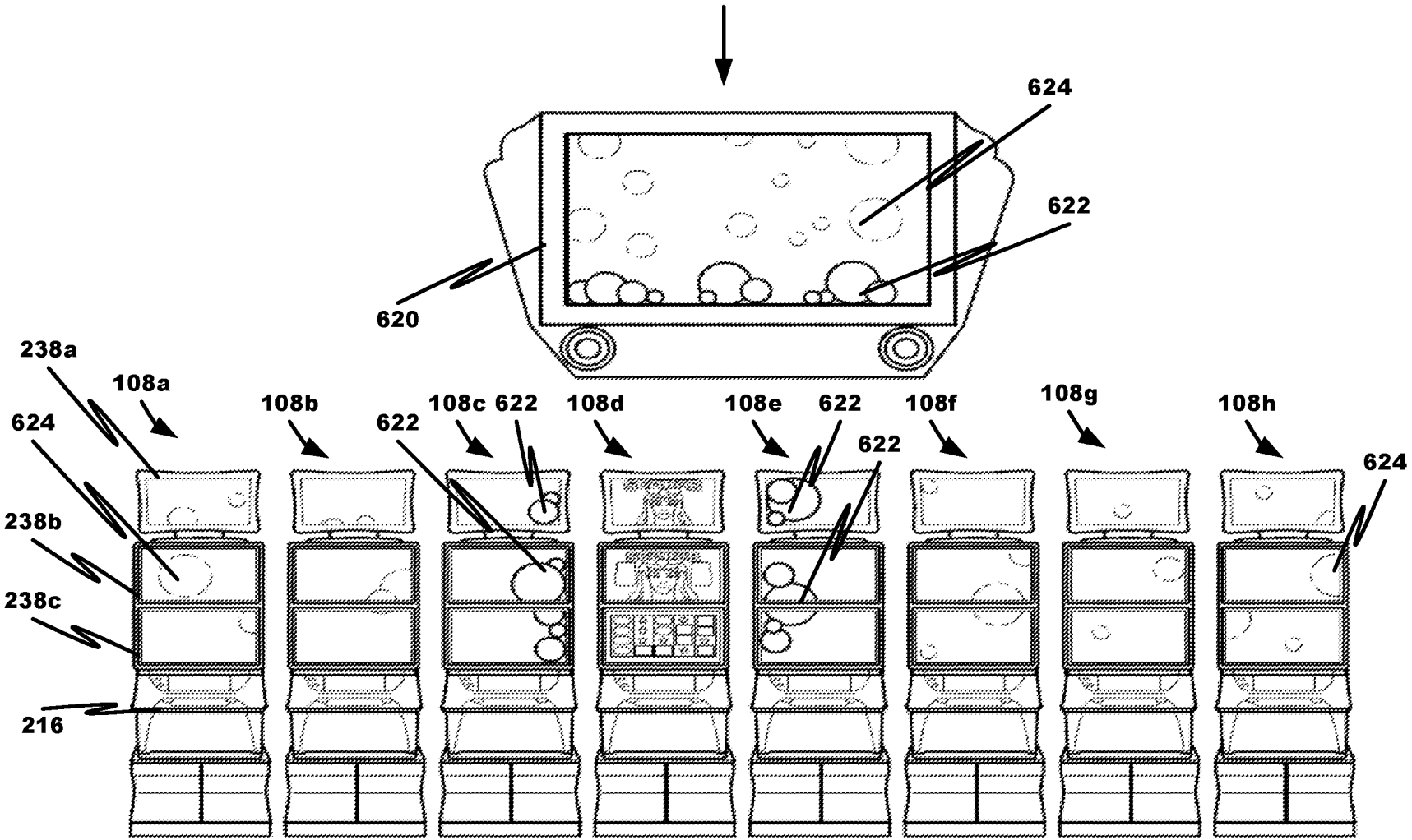
FIG. 6D depicts media content displayed by multiple gaming devices in accordance with at least some embodiments of the present disclosure.

With reference to FIG. 6D, a third exemplary presentation is depicted in connection with the bank 524 of gaming devices 108*a-h*. In the bank 524 of gaming devices 108*a-h*, objects depicted as balls 622 move inwardly on either side of a gaming device 108*d* that is in a play mode with a player. The balls not only move inwardly towards the gaming device 108*d* in the directions shown by the arrows and traverse multiple display devices 238 of multiple gaming devices 108 but also move downwardly towards the gaming device 108*d* and traverse a topper display device 620 positioned above the bank 524 of gaming devices 108*a-h*.

The dashed balls 624 and trajectory represent prior positions of the balls 622 as they move inwardly and downwardly towards the gaming device 108*d*. While the bank of gaming devices 524 is discussed with reference to eight gaming devices, it is to be understood that the principles of this disclosure apply to any number of gaming devices in a cluster and apply not only to gaming devices but also to mobile devices and other target gaming devices and combinations thereof.

Figure 6E:
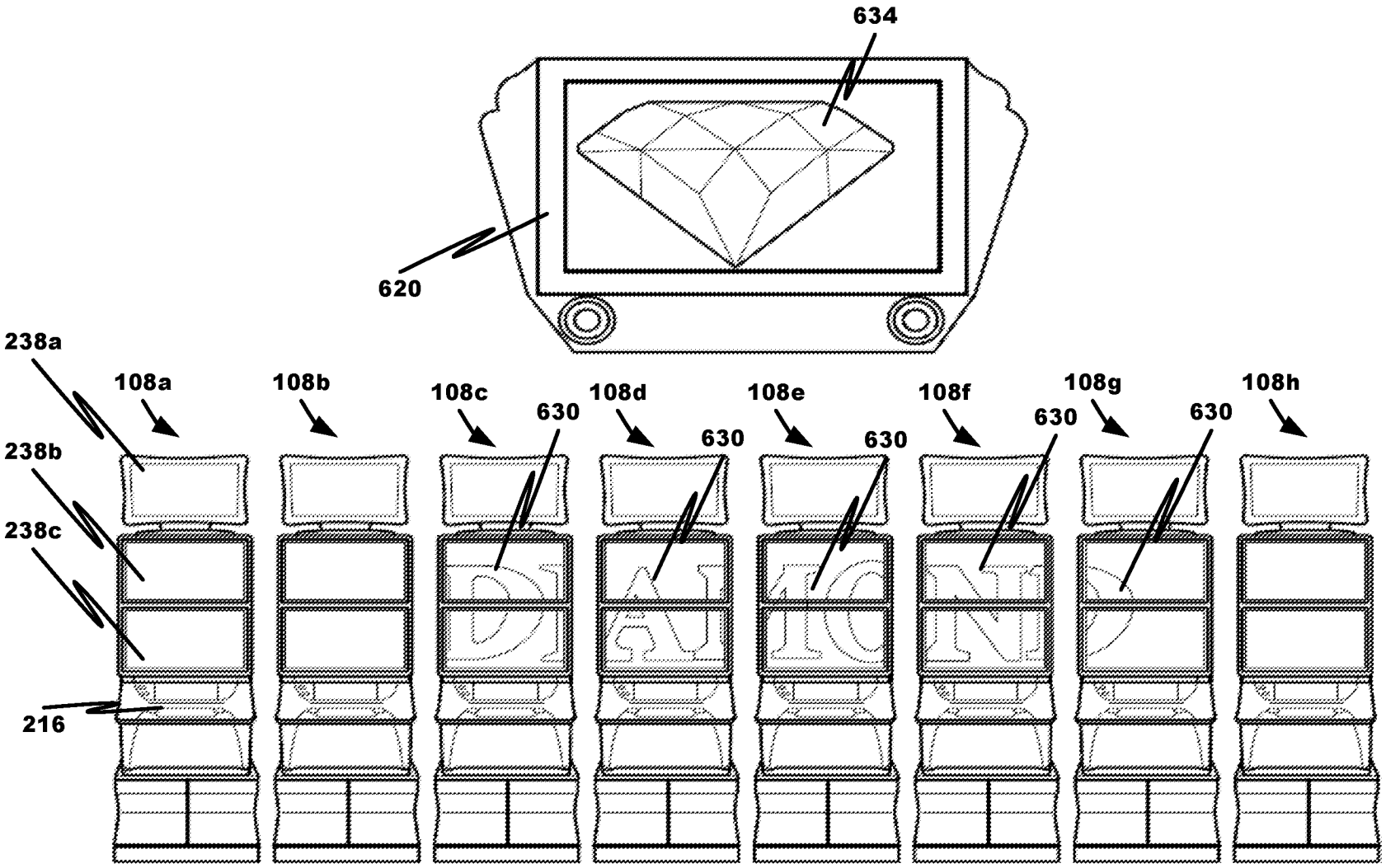
FIG. 6E depicts media content displayed by multiple gaming devices in accordance with at least some embodiments of the present disclosure.

With reference to FIG. 6E, a fourth exemplary presentation is depicted in connection with the bank 524 of gaming devices 108*a-h*. In the bank 524 of gaming devices 108*a-h*, a series of objects or letters 630 are depicted that collectively spell the name "DIAMOND" on the display devices 238*a-c* of the gaming devices 108*c-g* with a diamond 634 being displayed by the topper display device 620. As will be appreciated, the diamond presentation can advertise a slot game having a diamond-type object, such as a triple diamond, as a wild symbol. As can be seen by the various display devices 238 on the gaming devices 108, each gaming device 108 has different media content compared to other gaming devices 108 and each display device 238*a-c* of each gaming device 108 has different media content from the other display devices 238*a-c* of the same gaming device 108. Some of the display devices 238*a-c* do not display any letters 630 and simply display a background set of colors or other background content. While the bank of gaming devices 520 is discussed with reference to eight gaming devices, it is to be understood that the principles of this disclosure apply to any number of gaming devices in a cluster and apply not only to gaming devices but also to mobile devices and other target gaming devices and combinations thereof.

Figure 6F:
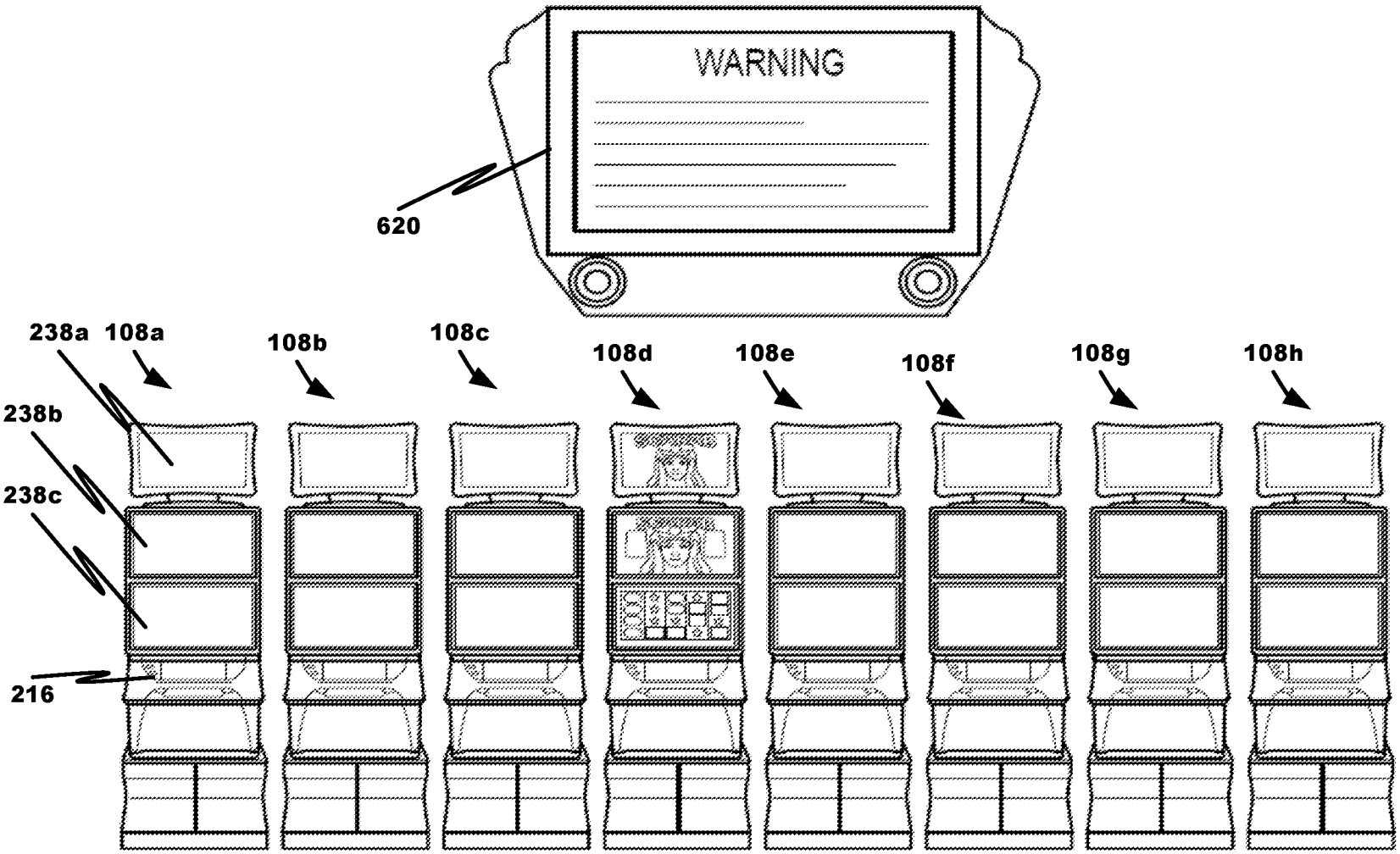
FIG. 6F depicts media content displayed by multiple gaming devices in accordance with at least some embodiments of the present disclosure.

With reference to FIG. 6F, a fifth exemplary presentation is depicted in connection with the bank 524 of gaming devices 108*a-h*. In the bank 524 of gaming devices 108*a-h*, gaming device 108*d* is in play mode while gaming devices 108*a-c* and *e-h* are in attract mode. The various display devices of the gaming devices 108*a-c* and *e-h* are displaying a series of colors or background pattern that change at a predetermined frequency and in a substantially synchronous manner. While the gaming server 116 sent a media content message to the topper display device 620 to provide the same media content as the display devices 238*a-c* of the gaming devices 108*a-c* and *e-h*, the processor controlling the topper display device 620 has applied a set of display requirement rules in the content display management instruction set 234 and/or display presentation instruction set 228 regarding required media content and elected to disregard the media content message and instead display warning content 650 mandated by local laws. While the bank of gaming devices 520 is discussed with reference to eight gaming devices, it is to be understood that the principles of this disclosure apply to any number of gaming devices in a cluster and apply not only to gaming devices but also to mobile devices, and other target gaming devices and combinations thereof.

Creating Presentations

Figure 7A:
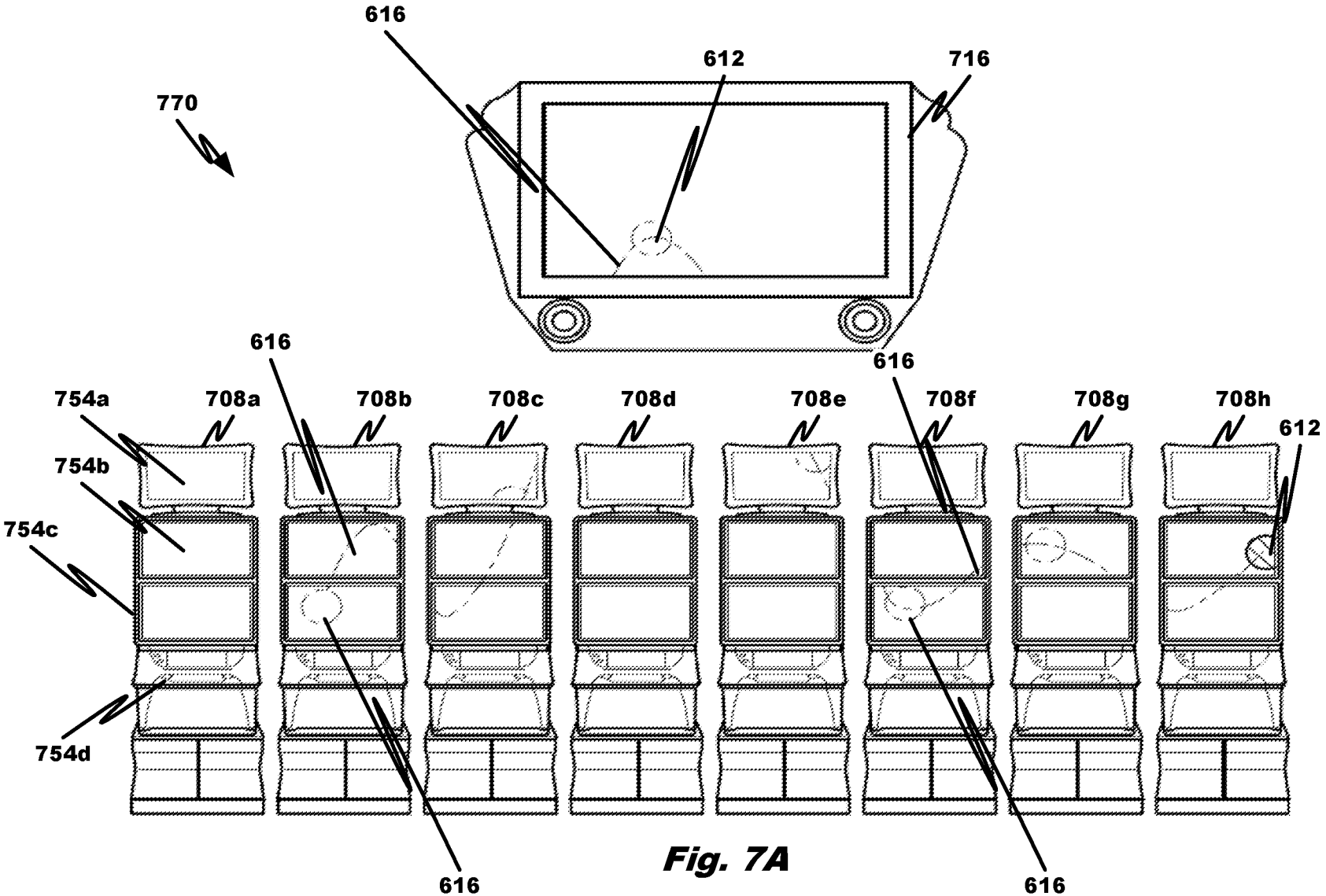
FIG. 7A is a media content generation display in accordance with at least some embodiments of the present disclosure.
Figure 7B:
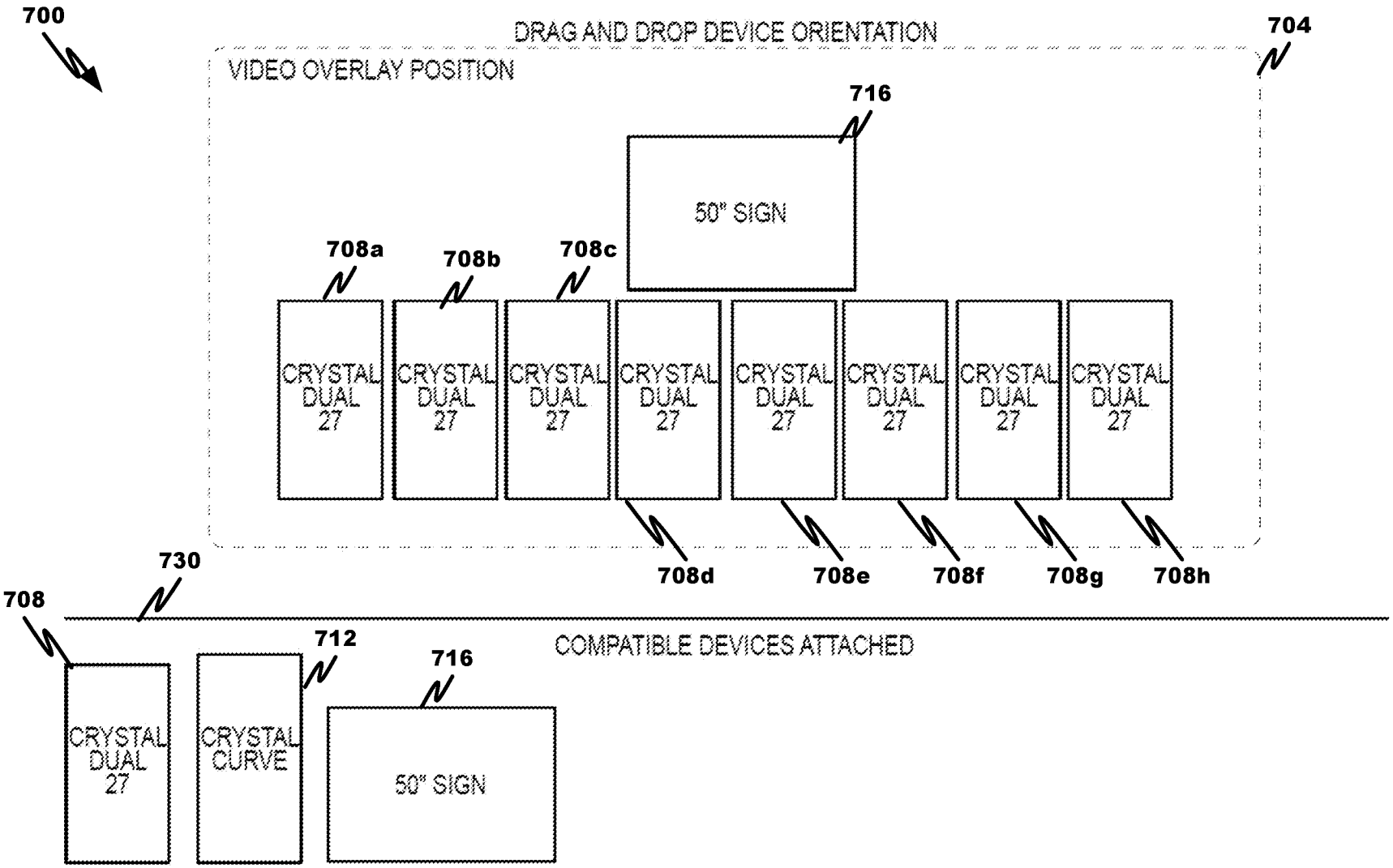
FIG. 7B is a media content generation display in accordance with at least some embodiments of the present disclosure.
Figure 7C:
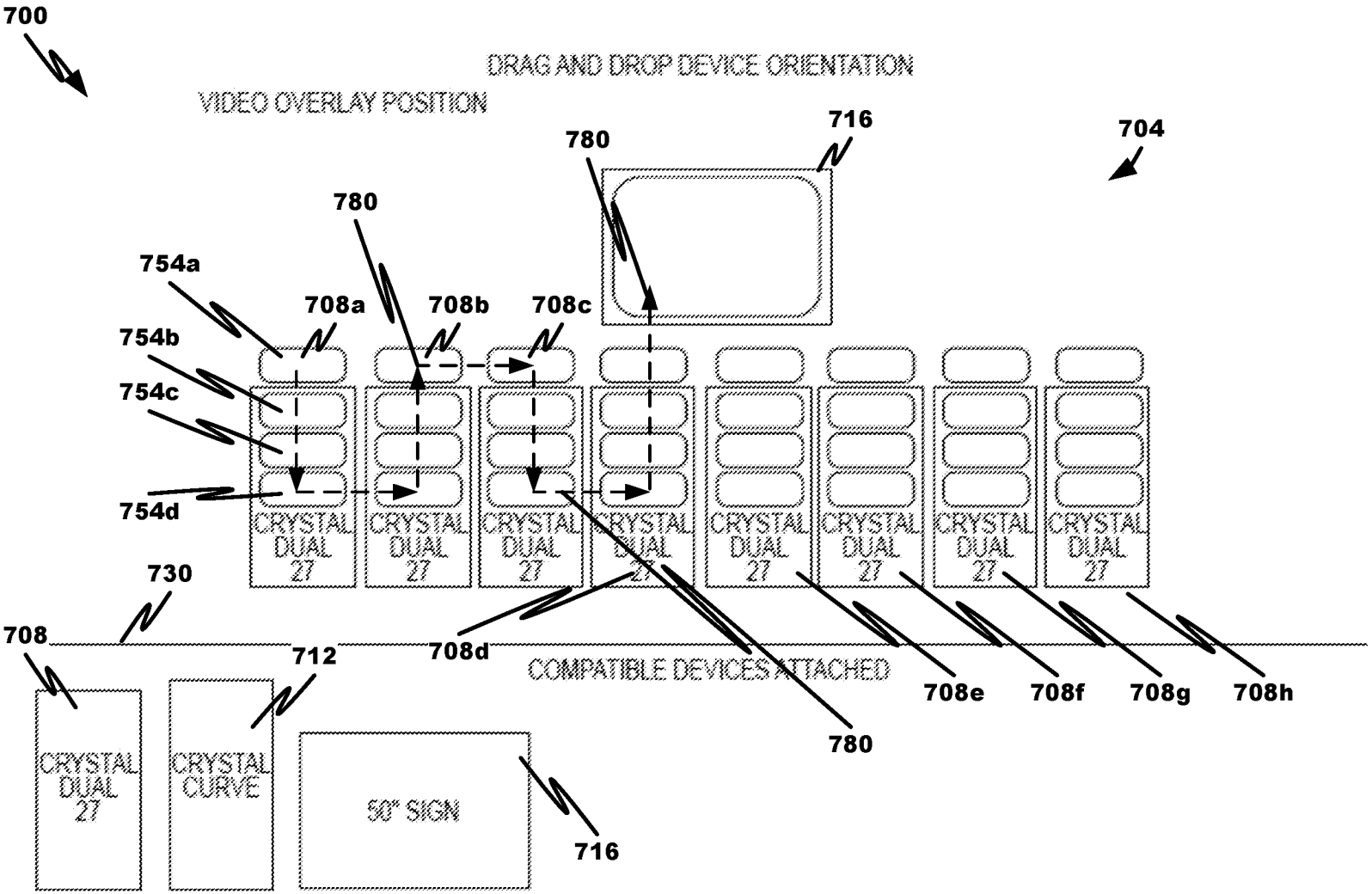
FIG. 7C is a media content generation display in accordance with at least some embodiments of the present disclosure.

With reference to FIGS. 7A-C, a further example will be discussed with reference to a system and method of creating and configuring media content for a multi-gaming device presentation in connection with the bank 524 of gaming devices 108*a-h*. The media content can be created and configured using a configuration application on a mobile device 128 or other type of computational device.

With reference to FIG. 7B, a displayed image 700 is captured showing, for the bank 524, each of the possible compatible gaming device types in the casino (e.g., crystal dual 27 708, crystal curve 712, and 50" sign 716 in the compatible devices attached region 730 of the display 700) from which the operator may select and a video overlay position region 704 of the display 700 comprising selected ones of the possible gaming device types spatially arranged as they appear in the common or selected area. The operator can select one of the compatible gaming device types and drag and drop it into the video overlay position region to orient the various gaming devices in the bank 524 in the same manner as the gaming devices are spatially oriented in the common or selected area. In the display 700, the crystal dual 27 708*a* corresponds to gaming device 108*a*, the crystal dual 27 708*b* corresponds to gaming device 108*b*, the crystal dual 27 708*c* corresponds to gaming device 108*c*, the crystal dual 27 708*d* corresponds to gaming device 108*d*, the crystal dual 27 708*e* corresponds to gaming device 108*e*, the crystal dual 27 708*fd* corresponds to gaming device 108*f*, the crystal dual 27 708*g* corresponds to gaming device 108*g*, the crystal dual 27 708*h* corresponds to gaming device 108*h*, and the 50" screen 716 corresponds to the topper display device 620.

Referring now to FIG. 7C, a further display 750 that may be derived from or associated with the display 700 is shown. The compatible devices attached region 730 of the display is the same as that of display 700. However, the video overlay position region 704 of the display shows the output device configurations and capabilities for the corresponding types of gaming devices in the bank 524. With respect to the crystal dual 708*a*, the output device icons 754*a-d* correspond, respectively, to the display device 238*a-c* and the user interface 216 of the corresponding gaming device 108*a*. By hovering a cursor over each output device icon 754, the configuration parameters of the output device (e.g., output device type, aspect ratio, contrast ratio, screen resolution, refresh rate, response time, screen size, DPI setting, and viewing angle) are displayed.

In this example, the operator can select a character or object from a drop-down list (not shown) to float or move among all of the output devices. The operator can set a pathway, or trajectory of object movement 780 for the object to follow and apply general personality traits (by way of non-limiting example, congratulatory or expectation to show something to recognize a highly ranked player). Touch-screen capabilities may also be used and configured. By way of non-limiting example, a player can touch a character or object to cause the object to run away through a variety of gaming device display devices. In some embodiments, the application, given the selected pathway 780, character or object, and personality trait can automatically generate or select a presentation from among a library of possible template presentations. In one application, the library includes a template presentation for each personality trait, character or object, and/or selected pathway that is automatically populated with the selected pathway and/or character or object.

With reference to FIG. 7A, a display 770 can be provided that simulates the presentation for possible editing by the operator. The display 770 provides a different view of the crystal dual 27 708*a-h* and output device icons 754*a-d* for each crystal dual 27 and the 50" screen 716 that mirrors the actual physical appearance of the corresponding gaming device. The selected object, namely a ball 612, is depicted along with its pathway 616 as it moves along the pathway selected in the display of FIG. 7C. The user can further select one or more colors and an appearance for the object and displayed background and other special effects for the presentation, including audio and tactile feedback.

The various displays of FIGS. 7A-7C can provide previews to ensure proper sizing and organizing of media content. By way of non-limiting example, the DPI and other display parameters of all of the gaming devices 108 and topper display device 620 in the bank 524 can be used to automatically resize the media content to be displayed by the corresponding display device the content stitching and pathways are clear. Methods can also be put into place where the gaming devices 108 can enter a mode where a digital image can be taken that automatically identifies the monitor type, size, resolution, DPI setting, and other display configuration parameters to import into the configuration software.

Methods

With reference now to FIGS. 9 thru 12, various methods will be described in accordance with at least some embodiments of the present disclosure. The various methods depicted and described herein may be performed with some or all of the system 100 components and should not be construed as being required to be performed within a particular system 100 component.

Figure 9:
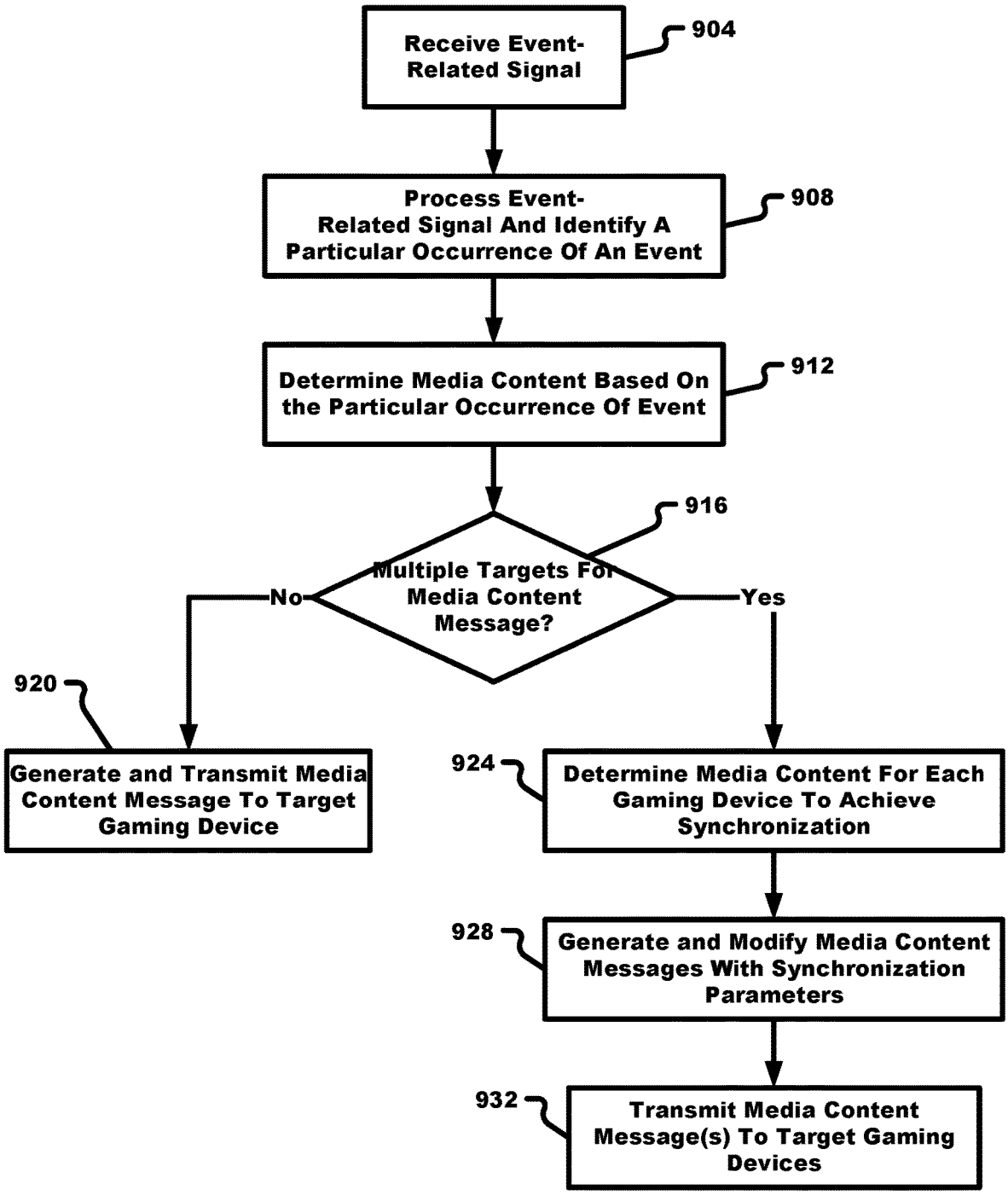
FIG. 9 is a flow diagram depicting a first method in accordance with at least some embodiments of the present disclosure.

Referring initially to FIG. 9, a first method will be described in accordance with at least some embodiments of the present disclosure. The method begins by receiving an event-related signal that includes event-related information encoded therein (step 904). The event-related signal may be received at a gaming server 116 or a gaming device 108. The signal may be received at a data port or any other device known to be included in a network interface of the device that receives the data stream. In some embodiments, the data stream may include a continuous or non-continuous flow of data objects (e.g., data packets, messages, etc.).

The information payload of the event-related signal can take many forms. It can include, by way of non-limiting example, player information, gaming information, device information, or a combination thereof.

The method continues with the receiving device utilizing its processor to process the payload of the signal and identify a particular occurrence of an event from the information or data encoded in the signal (step 908).

Sensed events that are identified in processing the information payload can be of many types. The sensed event changes can be associated with a common gaming device or different gaming devices. The particular occurrence of a sensed event may correspond to the existence of a sensed event itself or to an outcome that occurs during a sensed event. Nonlimiting examples of sensed events include a state or mode of the gaming device (such as play mode, idle mode, attract mode, error mode, or offline mode), information relating to an identified player of a gaming device (such as a player ranking, winning history, preferences, etc.), gaming information relating to a game being played on a gaming device (such as a game outcome or state (e.g., score, award, winnings, or bonus or proficiency level) and the like), a change in odds associated with an outcome of a gaming device (such as a gaming device having an increased likelihood of a winning outcome sensed by metering or some other system), player or potential player activity in spatial proximity to a gaming device, and the association of gaming devices with one another.

The method may then continue with the receiving device utilizing its processor and possibly a different instruction set to determine media content for the presentation based on the particular occurrence of the sensed event. The presentation can be maintained in a library of media content maintained in database 124. In some embodiments, the various presentations are mapped against event types or identifiers. Alternatively or additionally, the various presentations can be mapped against data sets, or field values, of player information, game information and/or device information. As will be appreciated, the presentations can be indexed based on other criterion or criteria.

In decision diamond 916, the receiving device utilizing its processor and possibly a different instruction set identifies whether or not there are multiple target gaming devices for the presentation or media content. In some embodiments, the decision depends on event type and/or presentation requirements. By way of non-limiting example, when the event is the interaction of a particular player with a gaming device 108, the processor may select only the interacting gaming device 108 as the target gaming device to provide the presentation. When the event is a bank of gaming devices being in a common mode, such as the attract or idle mode, the processor may select, as target gaming devices, all of the gaming devices in the bank to provide, substantially simultaneously, corresponding portions of the media content that collectively provide the presentation. Alternatively or additionally, the decision can depend on the field values of player information, gaming information and/or device information. By way of non-limiting example, player preferences may require only a specific number of target gaming devices to be used in the presentation. In another example, the gaming information, such as the type of game, outcome of the game, or state of the game, may determine the number of target gaming devices to be used in the presentation. In yet another example, device information, such as a number of gaming devices in the common or selected area that are currently available or unavailable for the presentation, may determine the number of target gaming devices.

When there is only one target gaming device for the presentation, the receiving device utilizing its processor and possibly a different instruction set generates and transmits one or more media content messages based on the particular occurrence of the event (step 920)

When there are multiple target gaming devices for the presentation, the receiving device utilizing its processor and possibly a different instruction set determines the media content for each of the target gaming devices and optionally for each output device of each of the target gaming devices (step 924). The media content and associated synchronization parameters may be generated in an attempt to synchronize outputs of the multiple target gaming devices 108 or substantially enhance a presentation of the event at a display device (such as the topper output device 620) that is separate from the gaming devices 108 but on the same casino floor as the gaming devices 108. In some embodiments, the media content message may be generated to include one or more synchronization parameters that define actions to be taken by each of the target devices that receives the media content message. Such actions may correspond to device outputs that are audible and/or visible to a player 112 within proximity of the device.

The synchronization parameters included in the media content message(s) can be any parameter that will achieve a synchronization among recipient target gaming device among the outputs produced by the output devices of the recipient target gaming devices to collectively provide a presentation related to the event that triggered generation of the media content messages. The parameters that may be included in the media content messages may include delay parameters, clock parameters (such as referencing a common clock or providing information to synchronize multiple clocks), instructions to produce an output immediately upon receipt of the media content message, or combinations thereof. Other parameters that may be included in the media content message may include parameters that define or prescribe the output to be produced by the receiving target gaming device, output devices to be used in connection with producing the audible/visible output, settings to be applied at the output devices when producing the audible/visible output, or combinations thereof.

As will be appreciated, the synchronization parameters enable each recipient target gaming device to synchronize its output with the outputs produced by other recipient target gaming devices, even if those devices did not receive the same media content message or if the devices did not receive a counterpart media content message at substantially the same time (e.g., due to network delays).

The method may then continue by the receiving device utilizing its processor and possibly a different instruction set to generate one or more media content messages based on the particular occurrence of the event and modify each of the media content messages with synchronization parameters (step 928).

The receiving device utilizing its processor and possibly a different instruction set then transmits the media content messages to each of the target gaming devices 108, such as the gaming devices in the bank 520 or 524 (step 932).

Again, different media content messages may be transmitted to different target gaming devices. Alternatively, a common or generic media content message may be broadcast to the multiple target gaming devices without departing from the scope of the present disclosure. The media content messages may be transmitted to the target gaming devices to enable the devices to perform an action consistent with parameters defined within the media content message.

While the above flowchart has been discussed with reference to gaming devices 108 only as the target gaming devices, it is to be understood that it can also be directed to mobile devices 128 or combinations of gaming devices 108 and mobile devices 128 as the target gaming devices.

Figure 10:
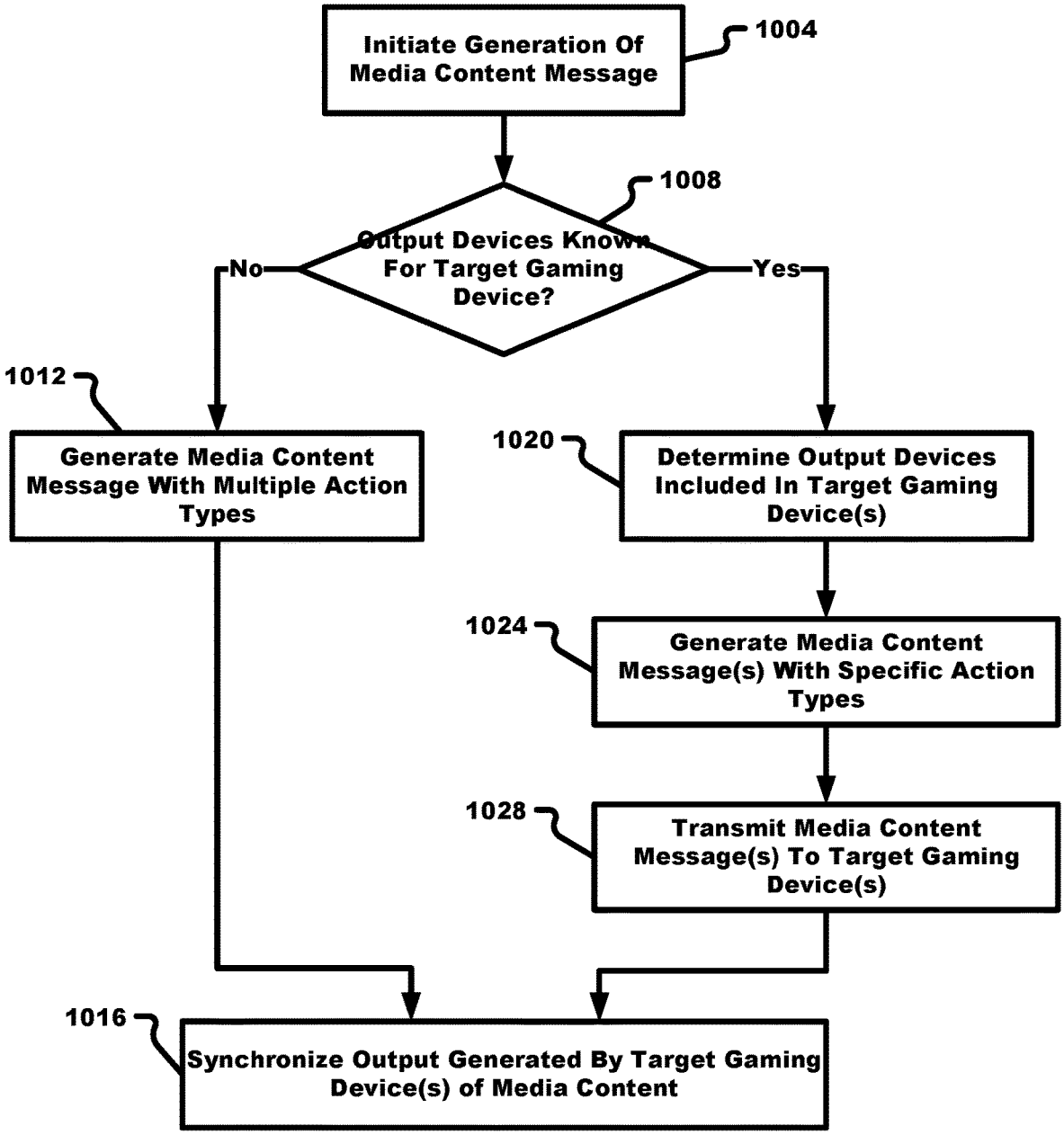
FIG. 10 is a flow diagram depicting a second method in accordance with at least some embodiments of the present disclosure.

With reference now to FIG. 10, a second method will be described in accordance with at least some embodiments of the present disclosure. The method begins when generation of a media content message is being initiated in response to a sensed event (step 1004) and continues by determining whether output devices are known for a target gaming device (step 1008). In some embodiments, this query may be answered positively if the device generating the media content message is maintaining target device capabilities 328 as described herein. Although the target device capabilities 328 were described as being stored in memory 308 of the gaming server 116, it should be appreciated that the target device capabilities 328 can be stored in memory 208 of a gaming device 108 without departing from the scope of the present disclosure.

If output devices are not known for the target gaming device (e.g., for a particular gaming device 108), then a generic media content message may be generated that includes parameters defining multiple types of actions to be taken by the recipient target gaming device (step 1012). The multiple different types of actions may be defined based on output devices that could be included in the recipient target gaming device. If the recipient target gaming device does not have an output device defined in the media content message, then the recipient target gaming device will simply not produce the associated output; however, if the recipient target gaming device does have an output device defined in the media content message, then the recipient target gaming device will utilize its output device to produce the associated output defined in the media content message. In some embodiments, the output(s) produced by the recipient target gaming device may be synchronized with the display of the event at a separate display device (step 1016). In some embodiments, the outputs produced by the recipient target gaming device may be synchronized with the display of the event that triggered the generation of the media content message.

Referring back to step 1008, if it is determined that multiple target gaming devices exist, then the method continues by determining the output devices that are included in the target gaming devices (step 1020). This determination may be made with reference to target device capabilities 328 stored in local memory.

The method will then continue by employing a processor to generate media content message(s) with specific action types based on the determined output devices of the target gaming device (step 1024). For instance, gaming devices 108 known to include RBG LEDs may be instructed to flash each of the colors of LEDs in a particular sequence via parameters in the media content messages transmitted to those gaming devices 108 whereas other gaming devices 108 known to include an LCD display may be instructed to flash the entire screen in a similar sequence of colors.

Each media content message may then be transmitted to the particular target gaming device having the known output devices (step 1028). The media content messages transmitted to each target gaming device may be unique to that target gaming device or may be common to all target gaming devices having similar types of output devices. Thus, groups of target gaming devices known to have similar or identical output devices may be provided with the same media content message.

Like the transmission of a generic media content message, the device-specific media content messages may be transmitted to target gaming devices in an attempt to synchronize the outputs produced by each recipient target gaming device with a display of the event that triggered by generation of the media content messages (step 1016). Again, the primary display of the event may be on a display device 620 that is physically separated from any gaming device 108 or target gaming device.

Figure 11:
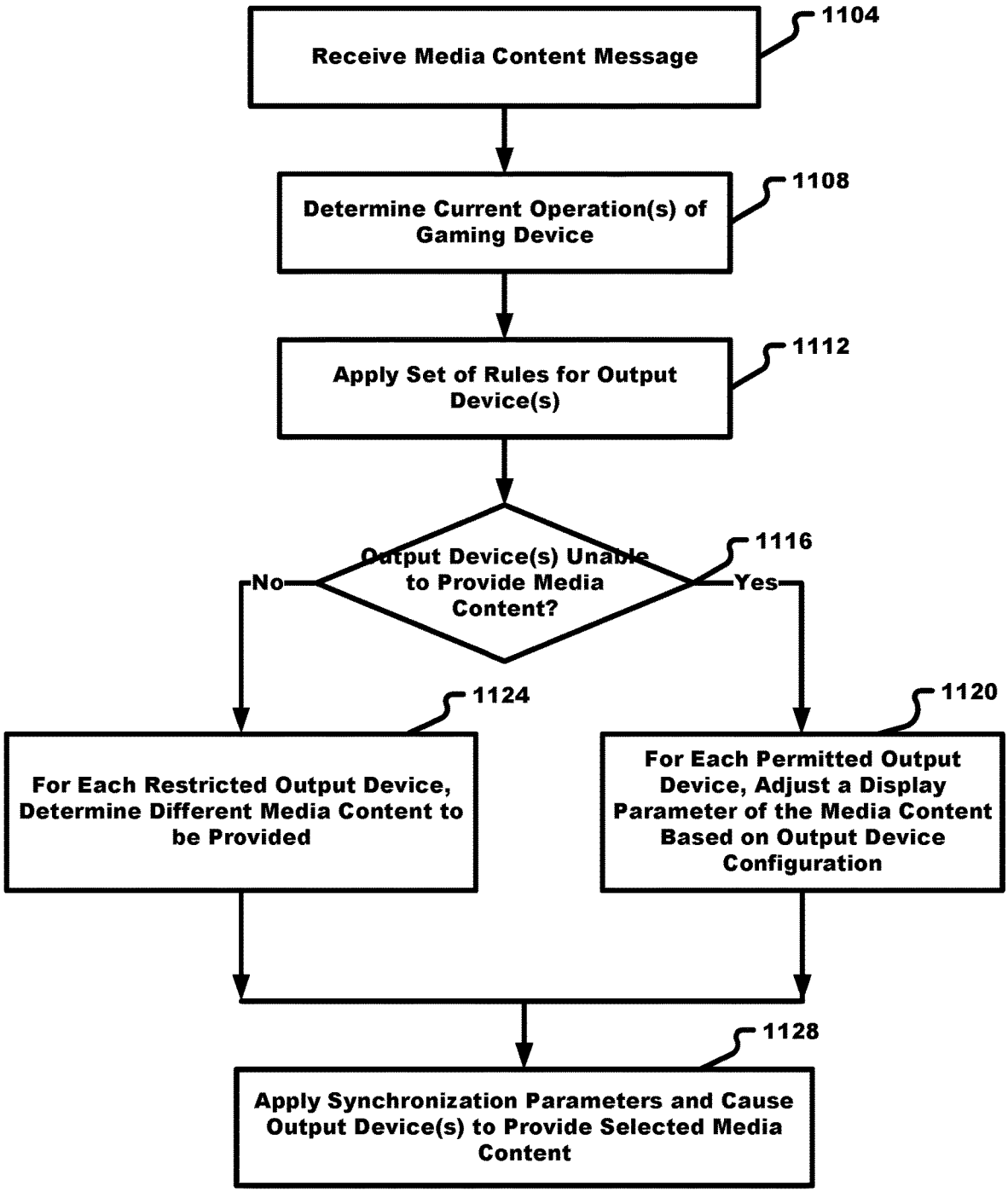
FIG. 11 is a flow diagram depicting a third method in accordance with at least some embodiments of the present disclosure.

With reference now to FIG. 11, a third method will be described in accordance with at least some embodiments of the present disclosure. The method begins by a processor of a target gaming device receiving one or more media content messages (step 1104).

The method may then continue by the processor determining current operation(s) or action(s) of the recipient target gaming device (step 1108) and applying a set of rules for the various output devices for the recipient target gaming device (step 1112). As noted above, each of the gaming devices can have discretion on whether or not to display the selected media content based on application of a set of rules. More specifically, and without limiting embodiments described herein, the set of rules can include: when the selected gaming device is performing a first action, the selected gaming device displays the selected media content; but when the selected gaming device is performing a different second action, the selected gaming device displays media content different from the selected media content. The second action can be required by governing statue, law, regulation, or other legal or operator requirement. In certain situations, one or more display devices is required to provide preselected content, such as player warnings, advisory messages, or other required media content. In some embodiments, the second action can be associated with an interaction with a player 112 directly or via a mobile device 128.

In response to application of the set of rules, the method may then continue by the processor determining which, if any, of the output devices is unable to provide media content (decision diamond 1116).

When there is one or more output devices that is restricted and unable to provide the selected media, the processor of the recipient target gaming device determines a different media content to be provided by the restricted output device (step 1124).

When there are no restricted output devices or when there is one or more output devices that are not restricted and able to provide the selected media, the processor determines and adjusts a display parameter of the media content based on the corresponding output device configuration (step 1120). The media content provided to each of the output devices of the recipient target gaming device can be altered to reflect their differing output device configurations. By way of example, and without limiting embodiments described herein, a display parameter associated with the media content can be adjusted for a first display configuration of a first display device and adjusted differently for a second display configuration of a second display device. The first and second display devices can be on the same gaming device or different gaming devices. The display parameter can be, for instance, aspect ratio, contrast ratio, screen resolution, refresh rate, response time, screen size, and/or viewing angle.

After steps 1124 and 1120, the processor applies the synchronization parameters to the modified media content from step 1120 to provide synchronized modified media content for each of the unrestricted output devices and causes the various output devices to provide the selected media content substantially synchronously with one another and with the output devices of other target gaming devices (step 1128). In some embodiments, multiple of the unrestricted output devices receive common synchronized modified media content. In some embodiments, multiple of the unrestricted output devices receive different synchronized modified media content.

Figure 12:
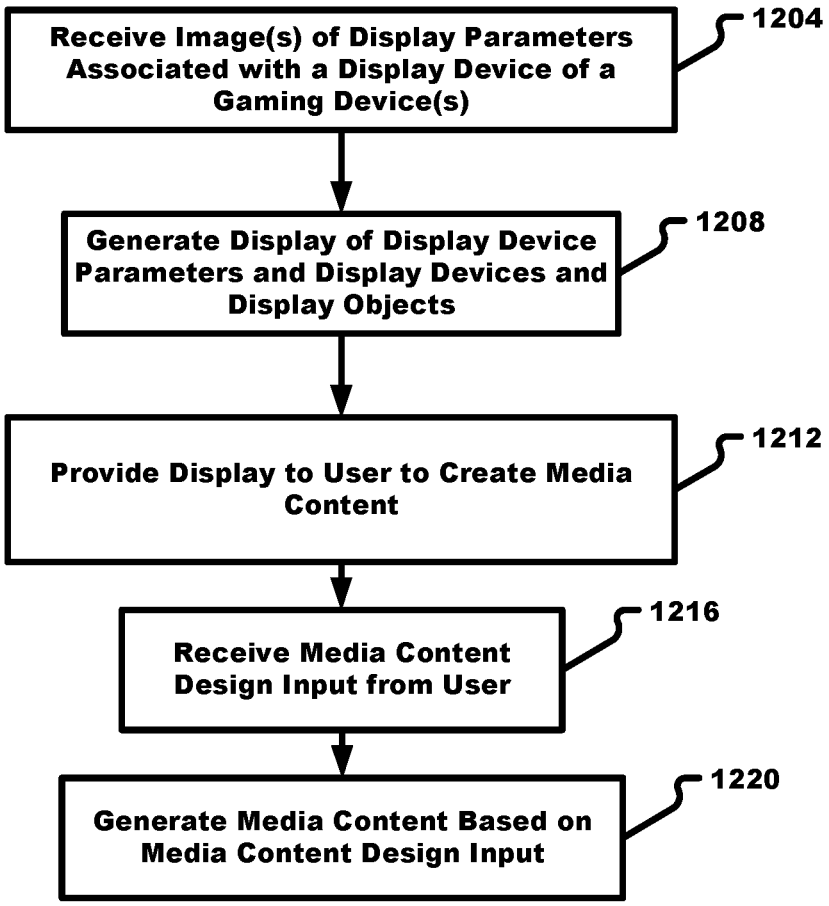
FIG. 12 is a flow diagram depicting a fourth method in accordance with at least some embodiments of the present disclosure.

With reference now to FIG. 12, a fourth method will be described in accordance with at least some embodiments of the present disclosure. The method begins by an application executing on a recipient target gaming device, such as a mobile device 128, or the gaming server 116 receiving image(s) of display parameters associated with a display device of a gaming device(s) (step 1204). This can be done by any suitable technique, such as a simple transfer of the display parameters in response to a query, extraction via the Simple network Management Protocol ("SNMP") from a Managed Information Base (MIB) describing the network objects on the gaming network 104 or communication network 120, or other techniques known to one of skill in the art. As will be appreciated, a managed object (sometimes called a MIB object or object) is one of any number of specific characteristics of a managed device. Managed objects are made up of one or more object instances, which are essentially variables. An object identifier uniquely identifies a managed object in the MIB hierarchy.

The processor of the recipient target gaming device or the gaming server 116 generates a display of the display device parameters and display devices and display objects (step 1212). Examples of such displays are shown in FIGS. 7A, 7B, and 7C. The display objects can be a drop down or pop up list of selected objects, such as balls, animated characters, letters, symbols, and the like. The display is then provided by the processor to a user, such as a casino operator, via a display of the recipient target gaming device to enable the user to create media content for a presentation (step 1212).

The recipient target gaming device receives a media content design from the user via interaction with the display (step 1216).

The recipient target gaming device or the gaming server, in response, generates a presentation based on the media content design, possibly using a template presentation retrieved from a presentation library in the database(s) 124, and stores and indexes the presentation in the database 124 (step 1220).

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming devices such as those located on a casino floor; and/or (c) one or more personal gaming devices, such as desktop computers, laptop computers, tablet computers or computing devices, personal digital assistants, mobile phones, and other mobile computing devices. Moreover, an EGM as used herein refers to any suitable electronic gaming device which enables a player to play a game (including but not limited to a game of chance, a game of skill, and/or a game of partial skill) to potentially win one or more awards, wherein the EGM comprises, but is not limited to: a slot machine, a video poker machine, a video lottery terminal, a terminal associated with an electronic table game, a video keno machine, a video bingo machine located on a casino floor, a sports betting terminal, or a kiosk, such as a sports betting kiosk.

In various embodiments, the gaming system of the present disclosure includes: (a) one or more electronic gaming devices in combination with one or more central servers, central controllers, or remote hosts; (b) one or more personal gaming devices in combination with one or more central servers, central controllers, or remote hosts; (c) one or more personal gaming devices in combination with one or more electronic gaming devices; (d) one or more personal gaming devices, one or more electronic gaming devices, and one or more central servers, central controllers, or remote hosts in combination with one another; (e) a single electronic gaming device; (f) a plurality of electronic gaming devices in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. By way of non-limiting example, the gaming system includes a plurality of EGMs that are each configured to communicate with a central server, central controller, or remote host through a data network.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a wide area network (WAN) in which one or more of the EGMs (or personal gaming devices) are not necessarily located substantially proximate to another one of the EGMs (or personal gaming devices) and/or the central server, central controller, or remote host. By way of non-limiting example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the communication network includes a WAN, the gaming system includes a central server, central controller, or remote host and an EGM (or personal gaming device) each located in a different gaming establishment in a same geographic area, such as a same city or a same state. Gaming systems in which the communication network includes a WAN are substantially identical to gaming systems in which the communication network includes a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique player name and password combination assigned to the player. The central server, central controller, or remote host may, however, identify the player in any other suitable manner, such as by validating a player tracking identification number associated with the player; by reading a player tracking card or other smart card inserted into a card reader; by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the player's computer, partly on the player's computer, as a stand-alone software package, partly on the player's computer and partly on a remote computer or entirely on the remote computer or server. In the latter scenario, the remote computer may be connected to the player's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A gaming server, comprising:

a signal input that interfaces with a network used for communication with a plurality of gaming devices;

a processor coupled with the signal input; and a computer-readable storage medium, coupled with the processor and comprising instructions stored thereon that, when executed by the processor, cause the processor to:

process event-related signals received at the signal input from the plurality of different gaming devices and identify a particular occurrence of an event based on processing the event-related signals, the particular occurrence of the event being associated with a selected gaming device of the plurality of different gaming devices;

based on the particular occurrence of the event, identify a target subset of the plurality of different gaming devices, the target subset of the plurality of different gaming devices comprising multiple gaming devices other than the selected gaming device, determine first media content to be provided by output devices of the gaming devices in the target subset of the plurality of gaming devices in response to the particular occurrence of the event, and separate the first media content into multiple different portions, each of the multiple different portions corresponding to a different gaming device in the plurality of gaming devices and comprising different media content, wherein the first media content is related to the event; and transmit a corresponding portion of the first media content to each gaming device in the target subset of the plurality of gaming devices.

2. The gaming server of claim 1, wherein the particular occurrence of the event comprises an action being performed by the selected gaming device, wherein the particular occurrence of the event does not involve an action being performed by any gaming device in the target subset of the plurality of gaming devices, wherein the first media content comprises multimedia content, wherein the processor generates and transmits, to the selected gaming device, second media content related to the event, wherein the second media content is to be provided by an output device of the selected gaming device, is different from the first media content, and, together with the first media content, defines a common presentation, wherein each of the first and second media content comprises a synchronization parameter that causes the output devices of the gaming devices in the target subset of the plurality of gaming devices and the selected gaming device to render synchronously the first and second media content, respectively, to provide the common presentation, and wherein the instructions, when executed by the processor, further cause the processor to determine the first and second media content by mapping an event type or identifier associated with the event against a plurality of library comprising plural media contents to select the first and second media content from among the plural media contents.

3. The gaming server of claim 2, wherein each of the gaming devices in the target subset of the plurality of gaming devices has discretion on whether or not to cause a corresponding output device to provide the corresponding portion of the first media content based on application of a set of rules, the set of rules comprising: when a gaming device is performing a first operation, the gaming device causes the output device of the gaming device to provide the first media content; and when the gaming device is performing a different second operation, the gaming device causes the output device of the gaming device to provide predetermined media content different from the first media content, wherein the first and second operations are associated with first and second states respectively, and wherein the first and second states comprise different ones of a play mode, idle mode, attract mode, error mode, and offline mode.

4. The gaming server of claim 1, wherein the output device of each of the gaming devices in the target subset of the plurality of gaming devices comprises first and second displays and wherein the respective gaming device determines that the first display but not the second display is available to display the corresponding portion of the first media content and causes the first display to display the corresponding portion of the first media content and the second display to display different media content, wherein the first media content comprises a synchronization parameter that causes each of the gaming devices in the target subset of the plurality of gaming devices to render synchronously the corresponding portion of the first media content, and wherein the synchronization parameter comprises a delay parameter and/or a clock parameter that provides a common point of initiation for rendering the different portions of the first media content.

5. The gaming server of claim 1, wherein the output device of each of the gaming devices in the target subset of the plurality of gaming devices comprises a first display and the selected gaming device comprises a second display, wherein a first display configuration of the first display is different from a second display configuration of the second display, and wherein the first media content comprises first media content to be displayed by each of the gaming devices in the target subset of the plurality of gaming devices and the selected gaming device, and wherein the instructions, when executed by the processor, further cause the processor to:

adjust a display parameter of the first media content based on the first and second display configurations to adapt the first media content to the first and second display configurations, respectively, the display parameter adjustment for the first display configuration being different than the display parameter adjustment for the second display configuration, wherein the display parameter comprises a plurality of aspect ratio, contrast ratio, screen resolution, refresh rate, response time, screen size, and viewing angle.

6. The gaming server of claim 1, wherein the event is associated with a gaming session between a player and the selected gaming device and wherein the first media content relates to the gaming session and wherein each of the gaming devices in the target subset of the plurality of gaming devices is configured to receive to receive a message comprising the first media content and retransmit at least a portion of the first media content to one or more other gaming devices in the target subset of the plurality of gaming devices.

7. The gaming server of claim 6, wherein the processor generates and transmits to the selected gaming device a second media content message related to the event, wherein the second media content message indicates selected second media content to be provided by an output device of the selected gaming device, wherein the first media content is different from the selected second media content, and wherein the first media content relates to player information associated with a player of the selected gaming device and game information of a gaming session between the player and the selected gaming device.

8. The gaming server of claim 1, wherein the particular occurrence of the event based on processing the event-related signals is associated with both of a gaming device in the target subset of the plurality of gaming devices and the selected gaming device and wherein the instructions, when executed by the processor, further cause the processor to:

receive a first image comprising a plurality of display parameters associated with a first display of each of the gaming devices in the target subset of the plurality of gaming devices, wherein the plurality of display parameters comprise a plurality of aspect ratio, contrast ratio, screen resolution, refresh rate, response time, screen size, and viewing angle;

receive a second image comprising a plurality of display parameters associated with a second display of the selected gaming device, wherein each of the gaming devices in the target subset of the plurality of gaming devices is spatially adjacent to the selected gaming device;

provide a user with a display comprising the first and second images and an object in the first media content to be displayed by the first and second displays;

receive from the user a trajectory of movement of the object across the first and second displays to be displayed by the first and second displays; and generate the first media content based on the trajectory of movement and the object, wherein the first media content is to be displayed by the first display in synchronization with display of second media content by the second display.

9. A gaming device, comprising:

a signal input that interfaces with a gaming network;

an output device to provide media content;

a processor coupled with the signal input and the output device; and a computer-readable storage medium, coupled with the processor and comprising instructions stored thereon that, when executed by the processor, cause the processor to:

receive, via the signal input, a media content message to provide selected media content related to an event associated with a different gaming device;

transmit at least a portion of the media content message to another gaming device other than the different gaming device to cause an output of the another gaming device to render the selected media content;

in response to the media content message, determines whether the gaming device is currently associated with a first operation or a different second operation; and when the gaming device is currently associated with the first operation, causes the output device to render the selected media content and, when the gaming device is currently associated with the second operation, causes the output device to render media content different from the selected media content and a different output device to render the selected media content.

10. The gaming device of claim 9, wherein the media content message comprises a synchronization parameter that provides timing requirements for the output device to render the selected media content synchronously with the another gaming device, wherein the first and second operations are associated with first and second states respectively, wherein the selected media content comprises multimedia content, wherein the media content message is received from a gaming server, wherein the media content message comprises the selected media content, and wherein the first and second states comprise different ones of a play mode, idle mode, attract mode, error mode, and offline mode.

11. The gaming device of claim 9, wherein the first and second operations are associated with different first and second operations of the processor, wherein the presentation of the selected media content by the output device is in accordance with a synchronization parameter that causes the presentation of the selected media content to be synchronized with presentation of the selected media content by an output device controlled by a different processor of the another gaming device, wherein the gaming device is associated with the first operation, and wherein the media content message is received from the different gaming device.

12. The gaming device of claim 9, wherein the output device comprises first and second displays, the first and second displays being controlled by the processor, and wherein the instructions, when executed by the processor, further cause the processor to:

determine that the first display but not the second display is available to display the selected media content; and cause the first display to display the selected media content and the second display to display different media content.

13. The gaming device of claim 9, wherein the output device comprises a display, wherein the media content message is received from a gaming server, wherein the display comprises first and second displays, wherein a first display configuration of the first display is different from a second display configuration of the second display, and wherein the media content message comprises the selected media content and wherein the instructions, when executed by the processor, further cause the processor to:

adjust a display parameter of the selected media content based on the first and second display configurations to adapt the selected media content to the first and second display configurations, respectively, the display parameter adjustment for the first display configuration being different than the display parameter adjustment for the second display configuration.

14. The gaming device of claim 13, wherein the display parameter is selected from aspect ratio, contrast ratio, screen resolution, refresh rate, response time, screen size, and viewing angle, wherein the selected media content comprises a synchronization parameter that causes each of the gaming device and the another gaming device to render synchronously the selected media content, and wherein the synchronization parameter comprises a delay parameter and/or a clock parameter that provides a common point of initiation for rendering the selected media content.

15. A method, comprising:

receiving, at a processor, a media content message to provide, by a display, selected media content;

in response to the media content message, determining, with the processor, whether a gaming device associated with the processor is currently associated with a first operation or a second operation; and applying, with the processor, the following rules:

when the gaming device is currently associated with the first operation, causing the display to render during a time period the selected media content, wherein a timing of the rendering of the selected media content by the display of the gaming device is based on a synchronization parameter, wherein the synchronization parameter comprises a delay parameter and/or a clock parameter that provides a common initiation point for multiple gaming devices comprising the gaming device to render the selected media content; and when the gaming device is currently associated with the second operation, providing during the time period and, by the display, media content different from the selected media content.

16. The method of claim 15, wherein the selected media content is related to an event associated with a gaming device controlled by a different processor, wherein the media content message is received from a gaming server, wherein the synchronization parameter causes the display to render the selected media content synchronously with provision of the selected media content by a display controlled by a different processor, wherein the media content message comprises the selected media content, wherein the selected media content comprises multimedia content, wherein the first and second operations are associated with first and second states respectively, and wherein the first and second states comprise different ones of a play mode, idle mode, attract mode, error mode, and offline mode, and wherein the different processor is associated with a different gaming device.

17. The method of claim 15, wherein the gaming device is associated with the first operation, wherein the first and second operations are associated with different first and second operations of the processor, wherein the rendering of the selected media content by the display is related to an event associated with another gaming device controlled by a different processor, and wherein the media content message is received from the another gaming device.

18. The method of claim 15, wherein the display comprises first and second displays, the first and second displays being controlled by the processor, and further comprising:

determining, with the processor, that the first display but not the second display is available to display the selected media content; and causing the first display to display the selected media content and the second display to display different media content.

19. The method of claim 15, wherein the media content message is received from a gaming server, wherein the display comprises first and second displays, wherein a first display configuration of the first display is different from a second display configuration of the second display, and wherein the media content message comprises the selected media content and further comprising:

adjusting a display parameter of the selected media content based on the first and second display configurations to adapt the selected media content to the first and second display configurations, respectively, the display parameter adjustment for the first display configuration being different than the display parameter adjustment for the second display configuration, wherein the display parameter comprises a plurality of aspect ratio, contrast ratio, screen resolution, refresh rate, response time, screen size, and viewing angle.

20. The method of claim 15, wherein the synchronization parameter causes the display to provide the selected media content synchronously with rendering of the selected media content by a display controlled by a different processor, and further comprising:

providing, by the gaming device to a gaming server in communication with the gaming device, a first image comprising a plurality of display parameters associated with the display, wherein the plurality of display parameters comprises a plurality of aspect ratio, contrast ratio, screen resolution, refresh rate, response time, screen size, and viewing angle;

receiving, by the gaming server, a second image comprising a plurality of display parameters associated with a display of another gaming device in spatial proximity to the gaming device, the another gaming device comprising the different processor;

providing, by the gaming server, a user with a display comprising the first and second images and, as part of the selected media content, an object to be displayed by the first and second images;

receiving, by the gaming server and from the user, a trajectory of movement of the object across the first and second images; and generating the selected media content based on the trajectory of movement.

* * * * *